US005678395A

United States Patent [19]

Black, Jr.

[11] Patent Number: 5,678,395

[45] Date of Patent: Oct. 21, 1997

[54] APPARATUS AND METHOD FOR PRODUCING TRUSS PLATE BUNDLES

[75] Inventor: William H. Black, Jr., Edenton, N.C.

[73] Assignee: Tee-Lok Corporation, Edenton, N.C.

[21] Appl. No.: 583,413

[22] Filed: Jan. 5, 1996

Related U.S. Application Data

[60] Division of Ser. No. 364,609, Dec. 27, 1994, which is a continuation-in-part of Ser. No. 232,899, Apr. 25, 1994, Pat. No. 5,392,908.

[51] Int. Cl.[6] ..... B65B 13/04; B65B 35/30

[52] U.S. Cl. ..... 53/542; 53/544; 53/582; 53/589

[58] Field of Search ..... 53/399, 446, 447, 53/542, 544, 582, 589

[56] References Cited

U.S. PATENT DOCUMENTS

| | | |
|---|---|---|
| 2,271,632 | 2/1942 | Diehl . |
| 2,996,721 | 8/1961 | Black . |
| 3,100,301 | 8/1963 | Black . |
| 3,377,905 | 4/1968 | McAlpine . |
| 3,416,283 | 12/1968 | Sanford . |
| 3,473,362 | 10/1969 | Black et al. . |
| 3,498,170 | 3/1970 | Sanford . |
| 3,880,286 | 4/1975 | Wegener . |
| 3,963,452 | 6/1976 | Jureit et al. . |
| 4,225,095 | 9/1980 | Jureit et al. . |
| 4,251,168 | 2/1981 | Groetschel . |
| 4,427,145 | 1/1984 | Harris . |
| 4,965,740 | 10/1990 | Schofield et al. . |
| 5,218,813 | 6/1993 | Seidel . |
| 5,265,722 | 11/1993 | Schmidmeister . |
| 5,392,908 | 2/1995 | Black, Jr. . |

OTHER PUBLICATIONS

Tee–Lok, Inc. Truss Plate Package Photos (Photos 1–5).

*Finland's Makron Company Is A Master Machinery Producer; Automated Builder*; pp. 1, 4, 14 and 15; (Oct. 1992).

Brochure of *Makron Truss Plate Line TPL 50–8.*

Video regarding Truss Plate Packaging System.

*Primary Examiner*—Linda Johnson

*Attorney, Agent, or Firm*—Bell, Seltzer, Park & Gibson, P.A.

[57] ABSTRACT

An apparatus for bundling truss plates includes comprises means for forming a plurality of truss plates and means for forming these truss plates into a unitized bundle that is easily shipped, stored, and handled. The apparatus can include means for orienting each of the plurality of truss plates so that the backing members are substantially parallel to a predetermined plane, aligning means for aligning the oriented truss plates so that the peripheries of their backing members are substantially aligned, stacking means for stacking the oriented and aligned truss plates, and interconnecting means for interconnecting the stacked truss plates into a unitized bundle.

20 Claims, 10 Drawing Sheets

APPARATUS AND METHOD FOR PRODUCING TRUSS PLATE BUNDLES

RELATED APPLICATIONS

This application is a divisional of application Ser. No. 08/364,609, filed 27 Dec. 1994 which is a continuation-in-part of application Ser. No. 08/232,899 filed 25 Apr. 1994 for PACKAGING METHOD AND CONFIGURATION FOR TRUSS PLATES, now U.S. Pat. No. 5,392,908, the disclosure of which is hereby incorporated herein by reference in its entirety.

FIELD OF THE INVENTION

The present invention relates generally to the packaging of truss plates, and in particular relates to the automated packaging thereof.

BACKGROUND OF THE INVENTION

Truss plates are generally employed to join planks of lumber that form floor and roof trusses used in residential housing. Truss plates typically comprise a backing plate and an array of sharp spike-like impaling members that extend outwardly from the backing plate. Adjacent planks of a truss with coplanar surfaces can be permanently joined by pounding or pressing the backing member of a truss plate so that its impaling members penetrate the planks.

Truss plates are typically packaged in boxes or cartons in no particular order whatsoever; they are simply strewn haphazardly within their container. If the container is emptied or if it is somehow removed or destroyed, the truss plates spill and spread and can be quite hazardous until they are retrieved and restored. As a result, truss plates are generally stored on-site in their packaging cartons until use.

Co-pending and co-assigned U.S. patent application Ser. No. 08/232,899 to Black describes a truss plate packaging method and configuration in which truss plates are packaged in unitized bundles. The truss plates are arranged so that their respective backing members are substantially parallel, with the peripheries of the backing members being substantially aligned. The truss plates are then interconnected with some interconnecting means, such as a strap that snugly wraps around the truss plates, to form a unitized bundle. Such a bundle can be conveniently shipped, stored, and handled in the manufacture of trusses.

In spite of these advantages and others discussed in the co-pending and co-assigned patent application referenced hereinabove, the commercial viability of truss plate bundles is somewhat uncertain due to the difficulty and labor expense of assembling such bundles by hand. This operation can be quite time-consuming and requires workers with superior dexterity in both hands. Formation of bundles from individual truss plates requires a number of different operations, each of which should be automated if the production of truss plate bundles is to be commercially viable. The prior art is silent on methods and machinery for carrying out any of these individual steps for truss plate bundle production with automated equipment.

In view of the foregoing, it is an object of the present invention to provide a method for producing truss plate bundles that utilizes automated equipment and thereby reduces the labor costs associated with production.

It is also an object of the present invention to provide an automated apparatus that can produce truss plate bundles.

It is another object of the present invention to provide individual automated stations that can perform the steps needed to produce truss plate bundles with automated equipment.

SUMMARY OF THE INVENTION

These and other objects are satisfied by the present invention, which provides an automated apparatus and associated method for producing truss plate bundles. The truss plate bundles produced comprise a plurality of truss plates, each of which have a generally planar backing member and a plurality of impaling members extending from one side. The apparatus comprises means for forming the plurality of truss plates and means for forming these truss plates into a unitized bundle that is easily shipped, stored, and handled.

Preferably, the apparatus for forming truss plate bundles comprises orienting means for orienting each of the plurality of truss plates so that the backing members are substantially parallel to a predetermined plane, aligning means for aligning the oriented truss plates so that the peripheries of their backing members are substantially aligned, stacking means for stacking the oriented and aligned truss plates, and interconnecting means for interconnecting the stacked truss plates into a unitized bundle. Such an apparatus can produce truss plate bundles rapidly, thereby reducing dramatically the labor costs involved with producing such truss plate bundles by hand.

In one embodiment of the present invention, the orienting means comprises a generally horizontally-disposed shelf having a transverse edge and a receiving channel positioned below the shelf. The shelf is sized and positioned so that a transverse portion of a truss plate placed thereon is unsupported. The receiving channel has side walls sized and positioned so that receipt of a truss plate therein causes the received truss plate to take a predetermined orientation in which the backing member of each truss plate is generally parallel to a predetermined plane. Preferably, this orienting unit includes a shelf that has a pair of transverse edges; such a shelf is sized transversely so that, when a pair of truss plates are placed in side-by-side relationship thereon, with a transverse edge of each truss plate being adjacent a transverse edge of the other truss plate, and with the backing members of the truss plates being generally coplanar, non-adjacent transverse edges of the truss plates are unsupported by the shelf. It is also preferred that, when the truss plates are received by such a shelf, their impaling members extend downwardly, as truss plate pairs so received can be oriented so that their impaling members extend toward the backing member of the other truss plate of the pair. Such orientation enables truss plate pairs to be easily formed into cooperating pairs, in which the backing members of the truss plates are in overlying parallel contacting relationship with one another.

In another embodiment of the present invention, the aligning unit comprises conveying means for conveying the pair of truss plates from an orienting unit in which the truss plates are oriented as described above, retractable stop means for halting the movement of each of the truss plates in a respective predetermined position, and directing means for directing oriented and substantially aligned truss plates into contacting relationship. The predetermined positions for the truss plates are selected so that cessation of movement of the truss plates in the respective predetermined positions causes the peripheries of the truss plate backing members to be substantially aligned. The stop unit is movable between an extended position, in which the stop unit engages and halts movement of the truss plates, and a retracted position, in which the stop unit fails to engage the truss plates. Preferably, the aligning unit further includes a drive unit to drive oriented and aligned truss plates from the stop and directing means. The drive unit is preferably operatively coupled with the stop means and the directing means so that retraction of the stop means and actuation of the directing means is accompanied by engagement of the drive unit.

In an additional embodiment of the present invention, the stacking unit comprises means for forming a substack of oriented and aligned truss plates, means for receiving a substack of oriented and aligned truss plates, means for conveying the substack from the receiving means, and means for accumulating substacks conveyed by the conveying means. The conveying means is operably coupled with the receiving means such that, as the substack is being conveyed, the receiving means is inaccessible for receipt of another substack. The accumulating means is configured to receive a plurality of substacks and to retain each of these substacks in oriented, substantially aligned, and contacting stacked relationship with at least one other substack. The accumulating means accumulates substacks until a predetermined number of substacks comprising a truss plate stack has been accumulated.

In still another embodiment of the present invention, the interconnecting means comprises a banding unit that wraps a band around the truss plate stack to unitize the bundle, conveying means that conveys the stack to the banding unit that retains the stack in a stacked configuration, and compressing means that compresses the stack during banding in a direction substantially orthogonal to the truss plate backing members. Preferably, the conveying means and the compressing means are operatively coupled such that conveyance of the stack to the banding unit by the conveying means actuates the compressing means.

DETAILED DESCRIPTION OF THE PREFERRED EMBODIMENT OF THE INVENTION

Figure 1:
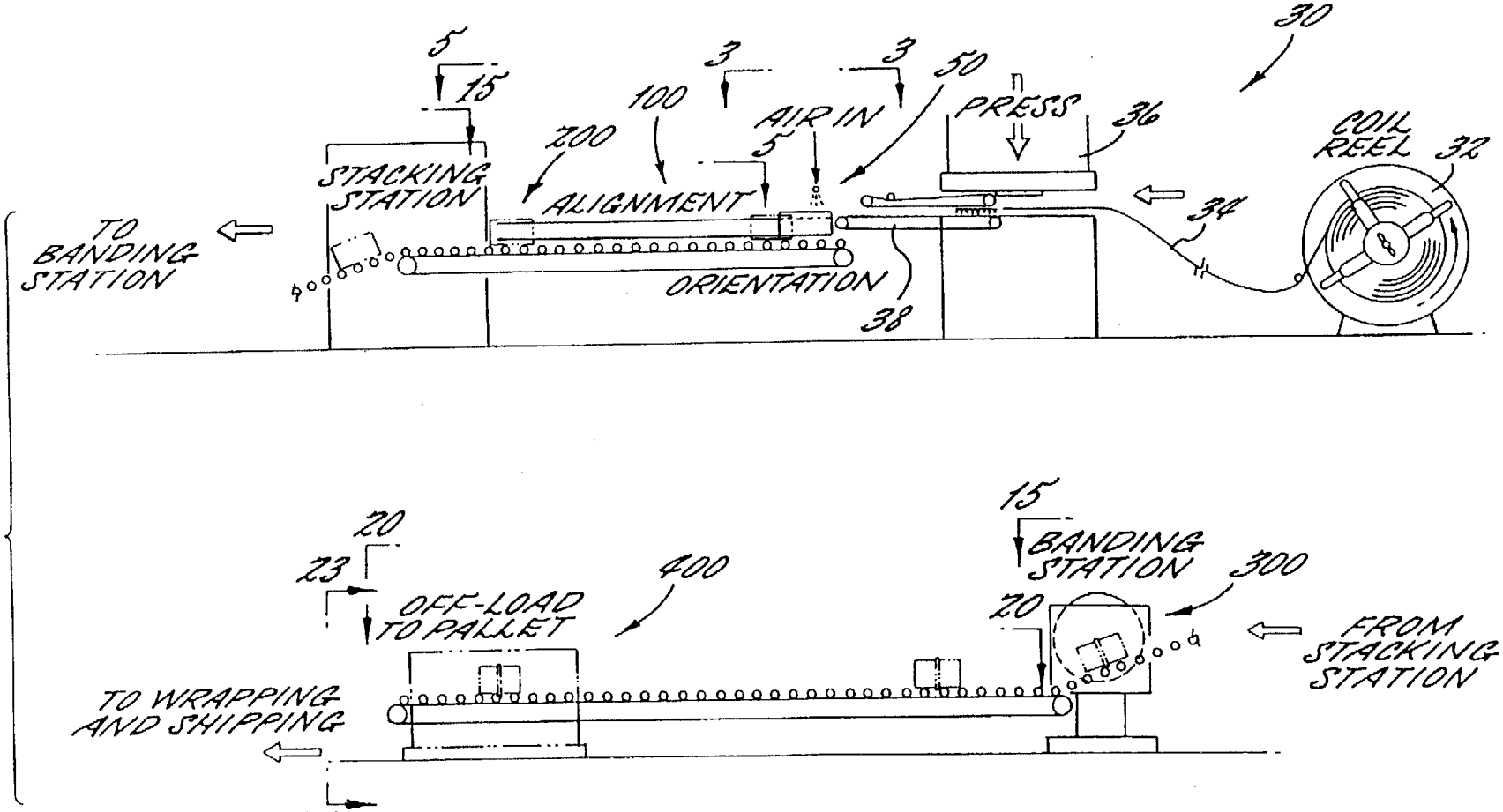
FIG. 1 is a schematic diagram of a truss plate bundle packaging apparatus according to the present invention.

The present invention will be described more particularly more hereinafter with reference to the accompanying drawings. The invention is not intended to be limited to the illustrated embodiments; rather, these embodiments are intended to fully and completely disclose the invention to those skilled in this art.

The present invention relates to a method and apparatus for packaging truss plates. The packaging method employs a number of different operations performed at separate manufacturing stations, with the truss plates being conveyed therebetween by different conveying means. In the description of the present invention that follows, certain terms are employed to refer to the positional relationship of certain structures relative to other structures. As used herein, the term "forward" and derivatives thereof refer to the general direction truss plates travel as they move from station to station; this term is intended to be synonymous with the term "downstream", which is often used in manufacturing environments to indicate that certain material being acted upon is farther along in the manufacturing process than other material. Conversely, the terms "rearward" and "upstream" and derivatives thereof refer to the directions opposite, respectively, the forward and downstream directions. Together, the forward and rearward directions comprise the "longitudinal" dimension. As used herein, the terms "outer", "outward", "lateral", and derivatives thereof refer to the direction defined by a vector originating at the longitudinal axis of a given structure and extending horizontally and perpendicularly thereto. Conversely, the terms "inner", inward", and derivatives thereof refer to the direction opposite that of the outward direction. Together, tile inward and outward directions comprise the "transverse" dimension. It should be noted that, relative to an absolute x-y-z coordinate axis system, these directions shift as the truss plates are conveyed between different operations due to the layout of equipment on the plant floor. When they occur, these shifts in absolute direction are noted hereinbelow, and the downstream direction is redefined with reference to structures illustrated in the drawings. It is to be understood that, when these shifts in the downstream direction occur, the other directions defined above shift similarly to retain their relative orientation with the downstream direction.

Figure 2:
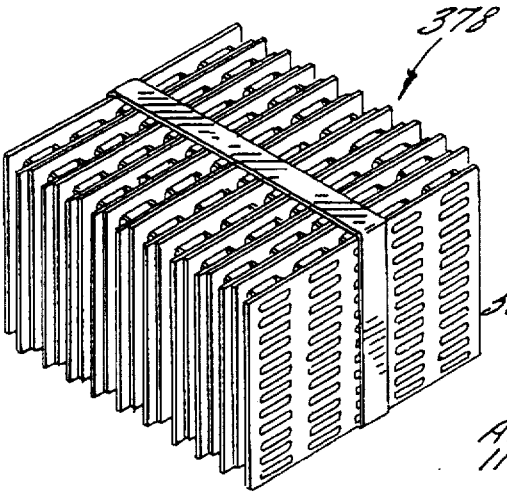
FIG. 2 is a perspective view of a truss plate bundle made by the apparatus shown in FIG. 1.

Referring now to the drawings, FIG. 1 illustrates schematically a truss plate packaging apparatus 30. The packaging apparatus 30 comprises a take-out wheel 32 that provides sheet material 34, a stamping press 36 that forms truss plates 40, an orientation station 50 that orients the truss plates 40 formed at the stamping press 36 so that their backing members are substantially parallel to a predetermined plane, an alignment station 100 that aligns the truss plates 40*a*, 40*b*, 40*c*, and 40*d* so that the peripheries of their backing members are substantially aligned, a stacking station 200 that stacks the oriented and aligned truss plates into a truss plate stack 261, a banding station 300 that encircles truss plate stacks 261 with an interconnecting strap 374 to produce a truss plate bundle 378 (FIG. 2), and an offloading station 400 that stacks the truss plate bundles 378 into a predetermined configuration on a pallet 422 for final enclosure and shipping.

The coil reel 32 (FIG. 1) stores a sheet material 34, which is typically steel ranging in thickness from between about 0.036 inches to 0.063 inches, in rolled form and provides it to the stamping press 36. Preferably, the sheet material 34 is of sufficient width (measured in the transverse direction) that an even number (i.e., two or four) of truss plates can be formed simultaneously from a single transverse strip of material, although virtually any number of truss plates formed from a single transverse strip of material can be used with the present invention. The take-out wheel 32 can be any known to those skilled in this art for providing sheet material to the stamping press 36; the skilled artisan will appreciate that other means for providing material to the stamping press 36 for truss plate formation, such as a roll-forming unit, can also be used with the present invention.

The stamping press 36 (FIG. 1) receives sheet material 34 and forms truss plates 40 therefrom. The truss plates 40 include a generally planar backing member and a plurality of impaling members that extend from one side thereof. The stamping press 36 slices the sheet material 34 longitudinally, strikes out the impaling members of individual truss plates, then slices the sheet material to form truss plates 40 having backing members of the desired size. Preferably, the stamping press 36 forms two or four truss plates simultaneously, and strikes out impaling members at a rate of between about 25 and 500 strokes per minute. It is also preferred that the stamping press 36 be configured so that, as the truss plates 40 emerge therefrom, the impaling members extend downwardly, although stamping presses that produce truss plates that emerge from the stamping process with their impaling members extending upwardly can also be used with the present invention. Those skilled in this art will appreciate that, although the aforementioned stamping press 36 is preferred, other stamping presses, and indeed other apparatus for forming truss plates, such as roll forming, can also be used in conjunction with the present invention.

The truss plates 40 (shown in FIG. 2 formed into a bundle) can take a variety of dimensions. For example, the thickness of the backing member and the impaling members, which is generally dependent upon the thickness of the sheet material 34, can vary from between about 0.036 and 0.063 inches, the length of the backing member can vary from about 1 inches to about 20 inches, and the backing member width can vary by a similar range. The impaling members can be arranged in perpendicularly disposed linear rows and columns, in linear columns with staggered rows, or other arrangements, although it is preferred that the impaling members be arranged so that two truss plates can be formed into a cooperating pair, in which the truss plates are in overlying contacting parallel relationship and in which the impaling members of each of the truss plates of the pair extend toward the backing member of the other truss plate of the pair. Truss plates suitable for use with the present invention are also discussed in co-assigned and co-pending U.S. patent application Ser. No. 08/232,899, the disclosure of which is incorporated herein by reference in its entirety.

Figure 3:
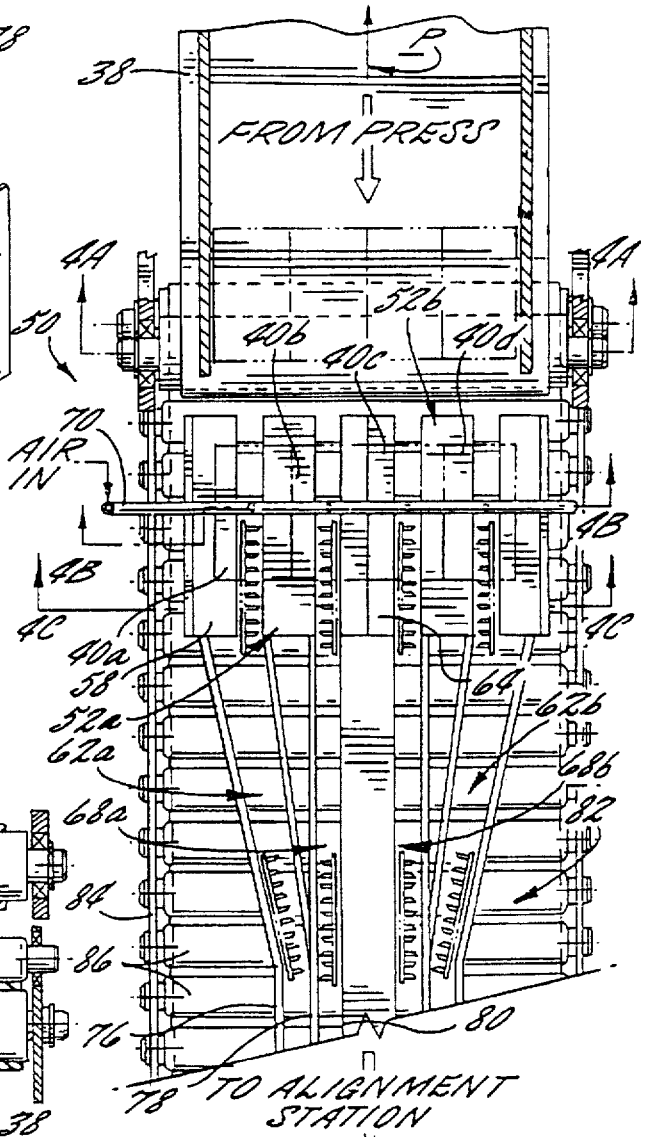
FIG. 3 is a partial cross-sectional view of the orientation station taken along lines 3—3 of FIG. 1.
Figure 4A:
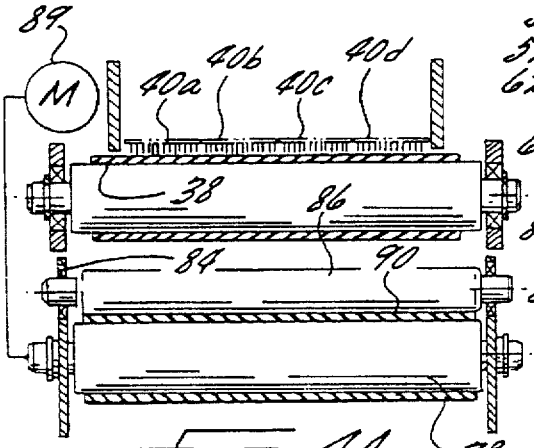
FIG. 4A is a cross-sectional view taken along lines 4A—4A of FIG. 3 showing the positional relationship between the belt conveyor leading from the stamping press and the roller conveyors positioned beneath the orientation station.

Upon exiting the stamping press 36, the truss plates 40 are conveyed via a belt conveyor 38 to the orientation station 50 (FIGS. 3 and 4A). In the illustrated embodiment, four truss plates 40*a*, 40*b*, 40*c*, and 40*d* are conveyed on the belt conveyor 38 in a transverse row; the plates are disposed in adjacent side-by-side relationship, with their longest dimension being directed longitudinally.

The orientation station 50 (FIG. 3) comprises a pair of platform shelves 52a, 52b, a pair of inner channels 68a, 68b, a pair of lateral channels 62a, 62b and a blower 70. The orientation station 50 has a plane of symmetry P (FIGS. 3 and 4B) that is vertically disposed and that extends longitudinally through the center of an inner ramp 64. In the interest of clarity and brevity, only the structures of the orientation station 50 residing on one side of the plane of symmetry P will be described in detail herein; those skilled in this art will appreciate that this discussion is equally applicable to those structures of the opposite side of the plane of symmetry P.

Figure 4B:
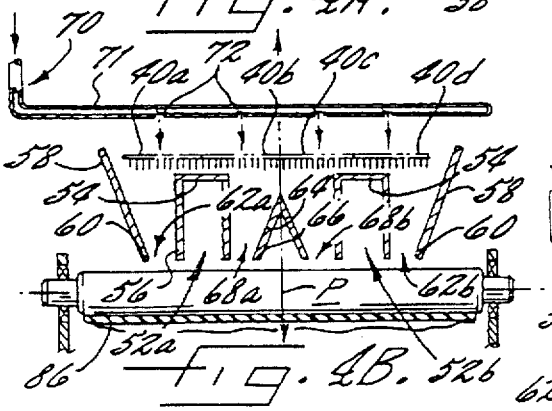
FIG. 4B is a cross-sectional view taken along lines 4B—4B of FIG. 3 showing the horizontal orientation of truss plates as they exit the belt conveyor and enter the orientation station.
Figure 4C:
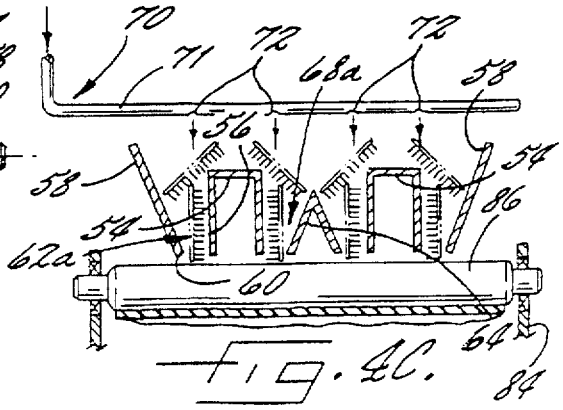
FIG. 4C is a cross-sectional view taking along lines 4C—4C of FIG. 3 showing how truss plates drop into their oriented vertical configuration.

The platform shelf 52a (FIGS. 3, 4B and 4C) extends downstream from the forward end of the belt conveyor 38. It comprises a generally planar upper face 54, a lateral face 56, and an inner face 57. The platform shelf 52a is positioned so that adjacent transverse edges of truss plates 40a, 40b are conveyed from the belt conveyor 38 onto the platform shelf upper face 54 (FIG. 4B). The upper face 54 is of a width such that the lateral edge of the truss plate 40a and the inner edge of the truss plate 40b are unsupported thereby; preferably, the upper face width is selected so that a major portion of each of the truss plates 40a, 40b is unsupported by the upper face 54. This configuration encourages the truss plates 40a, 40b conveyed to the upper face 54 to drop into, respectively, the lateral and inner channels 62, 68. In doing so, the truss plates 40a and 40b also rotate 90° about an axis generally parallel to the longitudinal axis of the platform shelf 52a to take a generally vertical orientation (FIG. 4C). This descension and rotation of the truss plates 40a, 40b is assisted by the blower 70, which comprises a manifold 71 mounted transversely above the platform shelf 52a and which includes two nozzles 72 that are directed downwardly and positioned above the unsupported transverse edges of the truss plates 40a, 40b. The manifold 71 is fluidly connected to an air source (not shown) that provides a continuous fluid stream for the nozzles 72.

The lateral channel 62a (FIGS. 3, 4B and 4C) is positioned laterally of the platform shelf 52a and is defined by the lateral face 56 of the platform shelf 54, a lateral ramp 58, and a series of rollers 86. The lateral face 56 of the platform shelf 52a extends generally downwardly from the lateral edge of the upper face 54, thereby forming the inner side wall of the lateral channel 62a. The lateral ramp 58, which extends forwardly from the downstream end of the belt conveyor 38, is generally planar and is mounted to slope inwardly from its upper to lower end. The lower edge 60 of the lateral ramp 58 is spaced from the lower edge of the platform shelf lateral face 56 so that the truss plate 40a dropping from the platform shelf upper face 54 can take and maintain a generally vertical orientation within the lateral channel 62a (FIG. 4C). The vertical orientation of the truss plate 40a is encouraged by the sloping disposition of the lateral ramp 58, as the lateral edge of the falling truss plate 40a strikes the surface of the lateral ramp 58 and slides downwardly into the lateral channel 62.

Similarly, the truss plate 40b drops from its position atop the platform shelf 52b and above the inner channel 68a into the inner channel 68a (FIGS. 4B and 4C). The inner channel 68a is defined by the inner face 57 of the platform shelf 52a, one wall of a V-shaped inner ramp 64, and the rollers 86 of the conveyor 83. The wall of the inner ramp 64 slopes laterally from its upper edge to its lower edge 66, and the lower edge 66 is spaced from the platform shelf inner face 57 so that the truss plate 40b can be received therein and remain in a generally vertical orientation.

Notably, after each of the truss plates 40a, 40b has fallen into and are oriented by, respectively, the lateral and inner channels 62a, 68a, the backing members of the truss plates are generally parallel, and the impaling members of each of the truss plates 40a, 40b extend toward the backing member of the other truss plate 40b, 40a (FIG. 4C). For reasons described in detail hereinafter and in co-assigned and co-pending U.S. patent application Ser. No. 08/232,899 cited and incorporated herein by reference hereinabove, this relative orientation of these adjacent truss plates 40a, 40b is preferred, as these truss plates can be formed into cooperating truss plate pairs; however, those skilled in this art will appreciate that other relative orientations of the truss plates, including one in which the impaling members of the truss plates 40a, 40b extend in the same direction, or in which only some adjacent truss plates are oriented to be later formed into cooperating pairs, can also be used with the present invention.

Those skilled in this art will appreciate that, although the platform shelf 52a and channels 62a, 68a illustrated herein are preferred, any means that orients truss plates in a predetermined orientation, and preferably so that their backing members are substantially parallel to a predetermined plane, is also suitable for use with the present invention. For example, a device having a pair of ramps and a pair of channels positioned between the ramps can be used. Such ramps receive truss plates having upwardly-extending impaling members and are configured so that the inner edges of the truss plates are unsupported. Truss plates passing over these ramps fall from the ramps so that their inner edges reside in the channel floors. The channels are configured so that as each truss plate is conveyed therein, it takes an orientation in which its backing member is parallel to the backing member of the other truss plate of the pair.

Another configuration that the orienting unit can take comprises a pair of adjacent panels having adjacent hinged transverse edges. As truss plates are conveyed onto these panels, the panels pivot about their respective hinges, thereby lifting and rotating the truss plates to face one another. Once the truss plates are in contacting relationship, they can be conveyed from the hinged panels. Another suitable configuration employs a magnetic lifter. As a pair of transversely adjacent truss plates are conveyed, one of the truss plates passes over the lifter. The lifter is energized and thus magnetized to attract its overlying truss plate. The lifter then rotates 180 degrees about a longitudinal axis (carrying the attracted truss plate) such that the truss plate is delivered to a position overlying the other truss plate of the pair.

Other alternatives for orienting truss plates include programmable robotic or otherwise automated articulating arms that mechanically, magnetically, hydraulically, or otherwise lift and place the truss plates in the desired orientation as they exit the stamping press, a vibrating set of channels that shakes truss plates emerging from the stamping press 36 into the desired orientation within the channels, and the like.

After having been directed into their respective predetermined orientations, the truss plates 40a, 40b are conveyed by the rollers 86 to the alignment station 100 (FIG. 4A). The rollers 86 are rotated about transverse axes within a frame 84 by a longitudinally-disposed belt 90, which is in turn driven by transversely-oriented rollers 88 powered by a motor 89. Those skilled in this art will appreciate that, although the rollers 86 illustrated herein are the preferred means for conveying the truss plates 40a, 40b to the alignment station 100, other conveying means, such as belt conveyors, inclined or flat slide conveyors, articulating arm units, and the like, can also be used with the present invention. The truss plates 40a, 40b are retained in their preferred orientations during this conveyance by vertical walls 76, 78, 80 (FIG. 3), which line the sides of the lateral and inner channels 62a, 68a and prevent the vertically-oriented truss plates 40a, 40b from tipping, twisting, or otherwise re-orienting to an undesirable orientation.

As noted above, mirror image structures carry out similar operations on the truss plates 40c, 40d, with the result that these truss plates 40c, 40d are oriented so that their backing members are generally vertically disposed and their respective impaling members extend toward the other truss plate 40d, 40c. This pair of truss plates 40c, 40d is then conveyed via the rollers 86 to the alignment station 100.

The alignment station 100 (FIG. 5) comprises a longitudinal position control assembly 102, which comprises a stop unit 104 and a drive unit 130, and a transverse position control assembly 150. Together, these assemblies 102, 150 control the relative longitudinal and transverse positions of the truss plates 40a, 40b, 40c, and 40d and form them into two cooperating truss plate pairs 101a, 101b, in which the truss plates comprising the pairs are in overlying contacting relationship and are arranged so that their backing members are substantially parallel and their impaling members of each truss plate extend toward the backing member of the other truss plate of the pair.

Figure 6B:
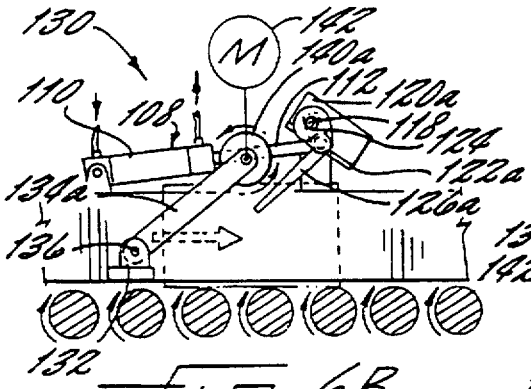
FIG. 6B is a side view partially in section taken along line 6B—6B of FIG. 5 showing the stop unit in its retracted position and the drive unit in its lowered operative position.
Figure 6A:
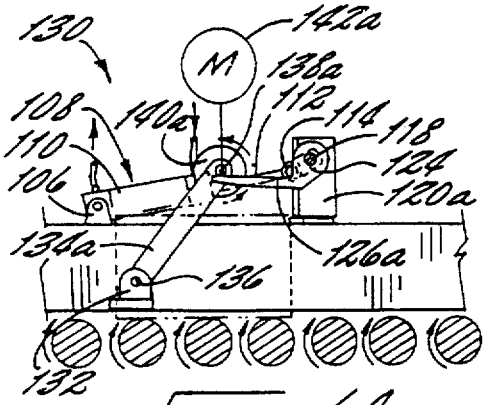
FIG. 6A is a side view partially in section of the stop unit and drive unit of the alignment station, with the stop unit being shown in its extended position and the drive unit being shown in its raised inoperative position.
Figure 5:
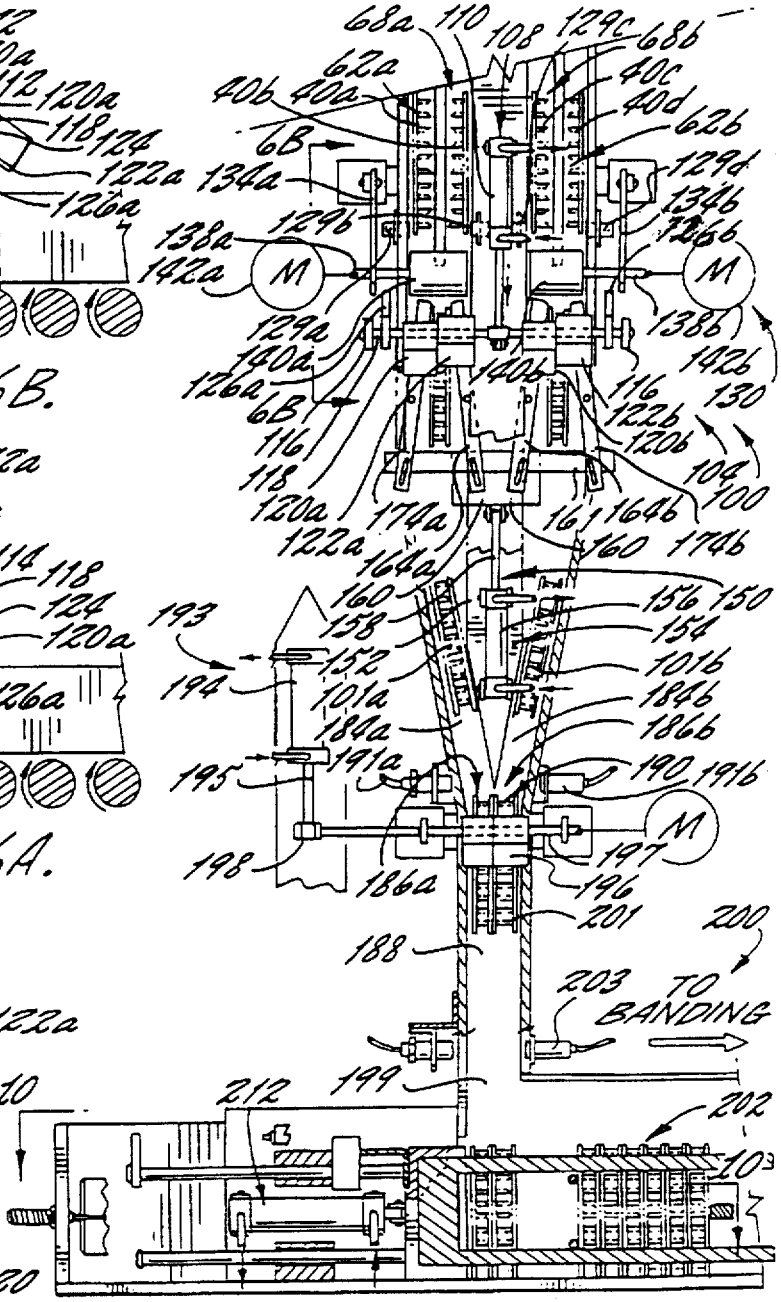
FIG. 5 is a partial sectional view of the alignment and stacking stations taken along line 5—5 of FIG. 1.
Figure 7B:
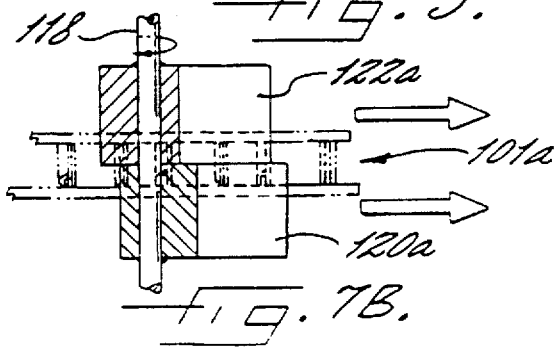
FIG. 7B is a view as in FIG. 7A illustrating the stop unit in its retracted position with truss plates being able to pass therebeneath.
Figure 24:
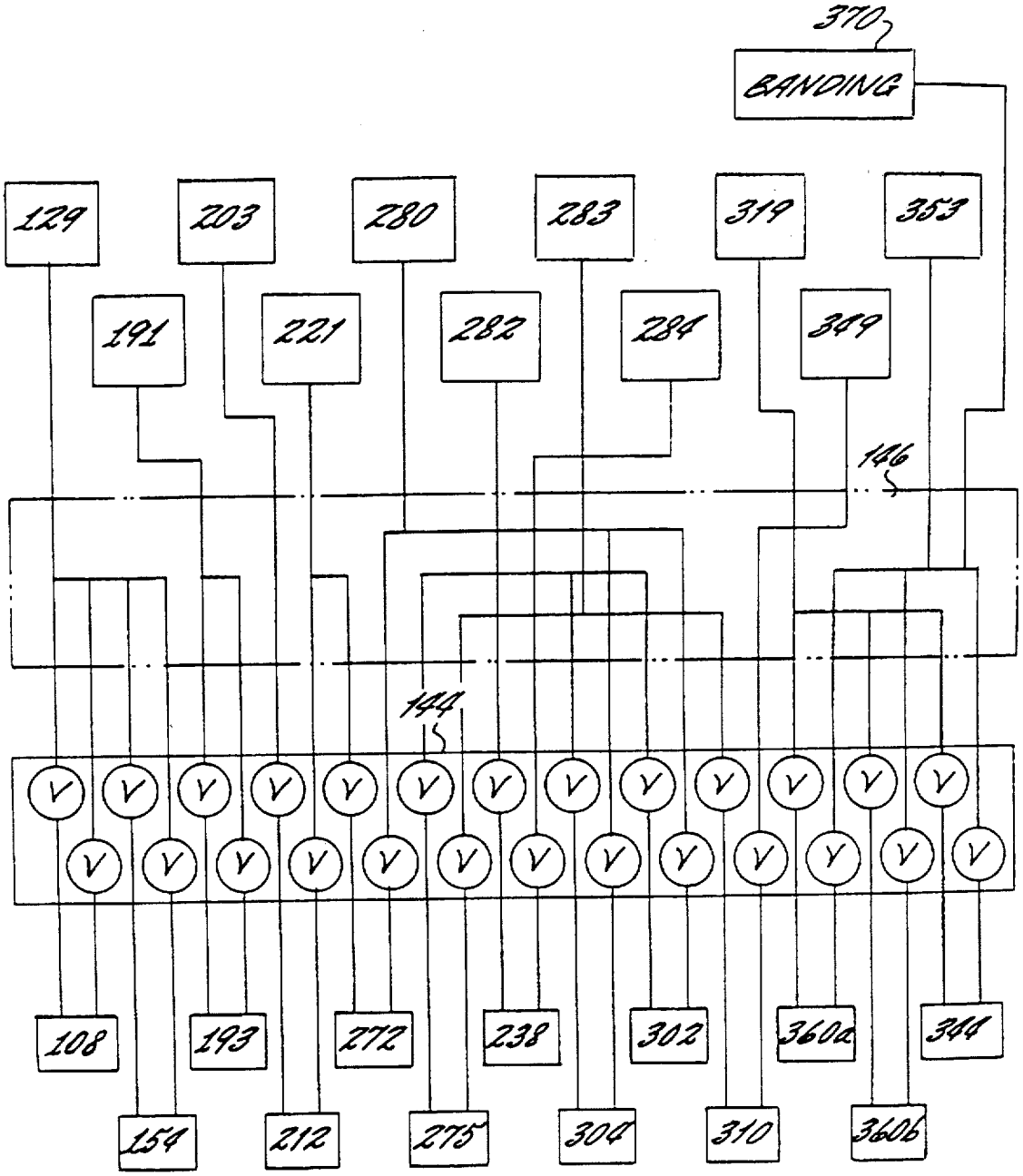
FIG. 24 is a schematic illustration showing the electrical and pneumatic interconnections of the proximity detectors, the controller, the air supply system, and the pneumatic cylinders employed in the alignment, stacking and banking station.

The stop unit 104 comprises a pneumatic cylinder unit 108 that includes a cylinder 110 and a shaft 112 that is extendable therefrom and retractable therein, a pair of forward stop blocks 120a, 120b, a pair of rearward stop bland a 122a, 122b, an axle 118, and a drive arm 124 (FIGS. 5, 6A and 6B). The pneumatic cylinder unit 108 is one of a number of pneumatic cylinder units employed in the illustrated embodiment of the present invention. Each of these units includes a hollow cylinder, within which is contained a plunger or piston, and a shaft that is connected to the plunger or piston and extends from one end of the cylinder. The cylinder is fluidly connected at each end via hoses to an air supply system 144 (represented schematically in FIG. 24 as a series of valve pairs). The shaft can be retracted within or extended from the cylinder by increasing the air pressure to the appropriate end of the cylinder through the appropriate hose. The air supply system 144 is configured so that it can, upon the appropriate signal, induce any cylinder unit to extend or retract independently of each of the other cylinder units. Those skilled in this art will appreciate that, unless otherwise noted, this discussion is equally applicable to the other pneumatic cylinder units illustrated and discussed hereinbelow. Those skilled in this art will also understand that, inasmuch as these pneumatic cylinder units are employed to create and control desired mechanical movement of components of the truss plate packaging system 30, other means for creating and controlling mechanical movement of these components, such as motor-driven four-bar linkages and other mechanical linkages, electronically- or magnetically-driven cylinder-shaft combinations, and the like can also be suitable for use with the present invention.

The cylinder 110, which extends longitudinally, is pivotally mounted at its rearward end to a frame bracket 106 via a pivot 114 (FIGS. 5, 6A and 6B. The shaft 112 is pivotally interconnected through a pivot 126 to one end of the drive arm 124, which is fixed at its opposite end to the central portion of the axle 118. The axle 118 is disposed transversely above the downstream ends of the lateral and inner channels 62a, 62b, 68a, 68b. The axle 118 is received at each end within apertures located in a pair of fixed frame members 116 and can rotate therein.

Figure 7A:
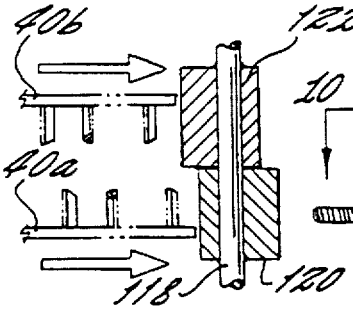
FIG. 7A is a greatly enlarged plan view partially in section illustrating the stop unit in its extended position showing its interaction with approaching truss plates.

The forward stop block 120a is fixed to a portion of the axle 118 so that it is positioned above the downstream end of the lateral channel 62a (FIG. 5). The rear stop block 122a is fixed to the axle 118 adjacent to and lateral of the forward stop block 120a, which positions the rear stop block above the downstream end of the inner channel 68a. The rear stop block 122a is mounted on the axle 118 so that its rearward surface is positioned slightly rearwardly from the rearward surface of the forward stop block 120a (FIG. 7A). Preferably, the longitudinal offset between the forward stop block 120a and the rearward stop block 122a is selected so that the truss plates 40a and 40b contacting these stop blocks are longitudinally offset from one another sufficiently that their impaling members of each truss plate can nest, rather than interfere, with the impaling members of the other truss plate. The forward stop block 120b is fixed to the axle 118 to reside above the downstream end of the inner channel 68b on the opposite side of the drive link 124 from the forward stop block 120a (FIG. 5). The rear stop block 122a is fixed to the axle 118 adjacent to and inward of the forward stop block 120b so that it resides above the downstream end of the lateral channel 68a and so that its rearwardmost surface is positioned slightly rearwardly of the rearwardmost surface of the forward stop block 122b. Again, the longitudinal offset between the forward and rearward stop blocks 120b, 122b is selected so that the impaling members of the truss plates 40c, 40d will nest with one another.

Four proximity detectors 129a, 129b, 129c, 129d are positioned at the downstream ends of, respectively, the lateral and inner channels 62a, 68a, 68b, 62b (FIG. 5); each proximity detector is directed toward the cavity defined by its respective channel. These proximity detectors are some of a number of proximity detectors employed in this embodiment of the present invention. These units electronically detect the presence or absence of an object (typically a magnetic object) in a particular location and provide an electrical or electronic signal as a result of such detection. In the present invention, the proximity detectors, unless otherwise noted, are electrically connected to a central electronic controller 146 (represented schematically in FIG. 24) that receives the signal and, based on software that processes these signals, immediately or on some time delay sends an electric signal to a mechanical, pneumatic, electrical, or other component of the truss plate packaging system 30 that actuates that component. For example, the proximity detectors 129a, 129b, 129c, 129d (represented collectively by 129 in FIG. 24) are electrically connected to the controller 146; when the controller 146 receives a signal from each of the proximity detectors 129a, 129b, 129c, 129d that truss plates have arrived in each of their respective channels, the controller 146, which is electrically connected to the air supply system 144, actuates the air supply system 144 to, inter alia, extend the shaft 112 of the cylinder unit 108. Those skilled in this art will appreciate that the controller 146 and the air supply source 144 may be separate units or may be constructed as a combined unit, such as a programmable manifold, configured to receive actuation signals, and to respond to such signals by applying pneumatic pressure to individual external devices.

In the discussion that ensues, reference will be made to proximity detectors and mechanical components being electrically connected to the controller 146. It is intended that those skilled in this art understand that such electrical connection refers to a configuration in which signals are transmitted from the proximity detector to the controller and signals are received by the mechanical component from the controller 146 in response thereto that actuate that mechanical component.

The drive unit 130 (FIGS. 5, 6A and 6B) comprises a pair of pivot links 134a, 134b, a pair of driveshafts 138a, 138b, a pair of drive wheels 140a, 140b, a pair of drive motors 142a, 142b, and a pair of lifter arms 126a, 126b. Each of the pivot links 134a, 134b is pivotally connected at one end via pivot 136 to a stationary frame 132. Each of the driveshafts 138a, 138b, which are disposed transversely, is then pivotally connected to the opposite end of its respective pivot link 134a, 134b at pivots 141. The drive wheels 140a, 140b are attached to the inward ends of their respective drive shafts 138a, 138b to reside above the downstream end of the lateral and inner channels 62a, 62b, 68a, 68b just upstream from the stop blocks 120a, 122a, 120b, 122b. Each of the driveshafts 140a, 140b extends laterally beyond the pivots 141 to connect to its respective continuously operating drive motor 142a, 142b. The lifter arms 126a, 126b are fixed to lateral portions of the axle 118; the lifter arms 126 extend downwardly and rearwardly sufficiently therefrom that their terminal ends underlie the driveshafts 138a, 138b.

The transverse position control unit 150 (FIGS. 5, 8A and 8B) comprises a pneumatic cylinder unit 154, a traveling panel 160, a pair of inner plates 164a, 164b, and a pair of lateral plates 174a, 174b. The pneumatic cylinder unit 154 comprises a longitudinally-disposed cylinder 156, which is attached at its downstream end to a stationary frame platform 152, and a shaft 158 that extends upstream from the cylinder 156 and is extendable therefrom and retractable therein. The upstream end of the shaft 158 is attached to the traveling panel 160, which has a transversely-extending cantilevered member 161. Four pins 162 extend upwardly from the cantilevered member 161.

The inner plates 164a, 164b (best seen in FIGS. 8A and 8B) are vertically and generally longitudinally disposed and are pivotally attached to the frame platform 152 at pivots 170 upstream of the traveling panel 160. Each inner plate 164a, 164b includes a forward extension tab 166, in which is formed a slot 168 that slidably receives one of the pins 162. Each slot 168 extends at a slight angle to the longitudinal axis of its respective plate so that its forward end is positioned slightly inwardly from its rearward end. Similarly, the lateral plates 174a, 174b are vertically and generally longitudinally disposed and are pivotally attached to the frame 152 at pivots 180. Each lateral plate 174a, 174b includes a forward extension tab 176, in which is formed a slot 178 that slidably receives one of the pins 162. Each slot 178 extends at a slight angle to the longitudinal axis of its respective plate so that its forward end is positioned slightly laterally from its rearward end. The rearward end portions 172 of the inner plates 164a, 164b are positioned just downstream of the drive wheels 140a, 140b, as are the rearward end portions of the lateral plates 174a, 174b. Each pair of lateral and inner plates 174a, 164a is transversely spaced so that pairs of truss plates 40 emerging from the lateral and inner channels 62a, 62b, 68a, 68b can be received therebetween.

Figure 8A:
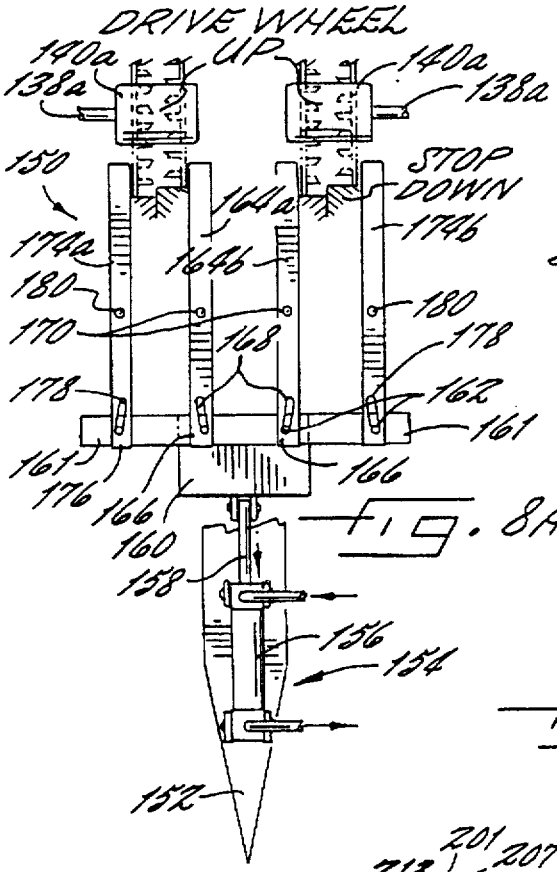
FIG. 8A is an enlarged plan view of the transverse positioning unit in its open position.

In operation, the truss plates 40a, 40b, 40c, 40d emerge from the orientation station 50 and are conveyed to the alignment station 100 by the rollers 86. Because the shaft 112 of the pneumatic cylinder unit 108 is in its retracted position (FIG. 6A), the stop blocks 120a, 122a, 120b, 122b are all in their lowered positions. The lifter arms 128 are positioned beneath the shaft 138 of the drive unit 130 and support the drive wheels 140a, 140b in a raised position above the vertical height of the truss plates 40a, 40b, 40c, 40d so that the drive wheels 140a, 140b do not engage the truss plates. Also, the shaft 158 of the cylinder unit 154 is in its retracted position (FIG. 8A). As a result, the pins 162 are in the forward ends of the slots 168, and the inner and lateral plates 164, 174 are generally parallel to the downstream direction.

The proximity detectors 129a, 129b, 129c, 129d monitor the movement of the truss plates 40a, 40b, 40c, 40d from the orientation station 50 to the alignment station 100; once each of the proximity detectors 129a, 129b, 129c, 129d detects a truss plate at its corresponding stop block 120a, 122a, 120b, 122b, it signals the controller 146. In these positions (FIG. 7A), the truss plates 40a, 40b, 40c, 40d are positioned so that the peripheries of their backing plates are substantially aligned, with the longitudinal offset between adjacent truss plates 40a and 40b being sufficient for the adjacent truss plates to nest when pressed together. It is intended that the term "substantially aligned" encompass truss plates in which a longitudinal offset of this magnitude is present.

Figure 8B:
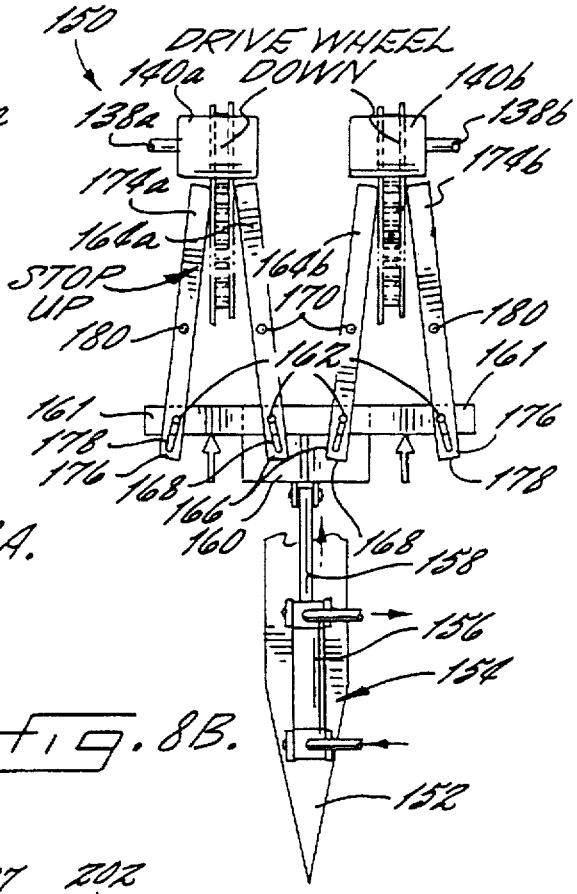
FIG. 8B is an enlarged plan view as in illustrating the transverse positioning unit in its closed position.

In response to the signals from all of the proximity detectors 129a, 129b, 129c, 129d, the controller 146 actuates the air supply system 144 to induce extension of the shaft 154 in the pneumatic cylinder unit 154 (FIG. 8B). This action drives the traveling panel 160 and its pins 162 rearwardly. Because the lateral and inner plates 164, 174 do not move longitudinally, the pins 162 move to the rearward end of the slots 168. This action forces the lateral and inner plates to pivot about the pivots 170, 180, respectively, and thereby forces their rear end portions 172, 182 toward the truss plates positioned therebetween. The contraction of the distance between the rear end portions 172, 182 forces the truss plates together to form cooperating pairs 101a, 101b.

After the truss plate pairs 101a, 101b have exited the alignment station 100, the controller 146 actuates the air supply system 144 to retract each of the pneumatic cylinder units 108, 154. These actions, which are induced by the controller 146 after a time delay of a predetermined length after the signals from the proximity detectors 129a, 129b, 129c, 129d are received, return the cylinder units 108, 154 to their respective retracted positions (FIGS. 6A and 8A).

Those skilled in this art will recognize that, although the illustrated set of stop blocks 120a, 122a, 120b, 122b is preferred, other means for longitudinally positioning truss plates so that their backing members are substantially aligned, as defined hereinabove, can also be used with the present invention. For example, articulating arm units that can grasp and precisely place individual truss plates into predetermined positions and orientations could be used, as could electromagnetic devices that, through magnetic attraction of the truss plates, position the truss plates precisely. It should also be noted that, in certain specific configurations, the channels in which the truss plates are conveyed can serve to align oriented truss plates as long as truss plates in adjacent exit the channels and come together essentially simultaneously, and are intended to be encompassed by the present invention. Also, although inclusion of the drive unit 130 is preferred for increased production speed, those skilled in this art will appreciate that alternative drive means, such as drive rollers, could also be used, and will further appreciate that drive means could be omitted altogether. In addition, although the transverse positioning means illustrated herein is preferred, alternative transverse positioning means are also suitable for use with the present invention. Exemplary alternatives include articulating arm units, pneumatic units that direct aligned truss plates to come into contacting relationship through the application of forced air thereto, conveying channels of that type described above that are configured so that adjacent truss plates arrive at a common reservoir simultaneously, and the like.

It is preferred, if alternative stop means or transverse positioning means are employed, that these units be operatively coupled such that the truss plates are aligned and brought into contacting relationship almost simultaneously, as such operative coupling can improve performance. It is also preferred that any drive means be operatively coupled with the stop unit and the transverse positioning unit, as such operative coupling can improve production speed.

As can be seen in FIG. 5, each of a pair of narrow channels 184a, 184b extends downstream from the inner and lateral plates 164a, 164b, 174a, 174b and terminates in an outlet 186a, 186b. The narrow channels 184a, 184b are of a width that a cooperating pair of truss plates 101a, 101b can be received and can travel therein without dissociating. These outlets 186a, 186b merge to feed into a wide channel 188. The wide channel 188 is of a width that two adjacent cooperating pairs of truss plates can be received and can travel therein without dissociating.

Adjacent the outlets 186a, 186b of the narrow channels, a gate 192 (FIG. 5) is positioned to ensure that the truss plates 40a, 40b, 40c, 40d remain in substantially aligned cooperating pairs 101a, 101b. The gate 192 comprises a pneumatic cylinder assembly 193 having a cylinder 194 and a shaft 195, a stop plate 196, and an axle 197 with a crank arm 198. The cylinder 194 is disposed generally longitudinally and is positioned laterally of the inlet 190. The shaft 195, which extends forwardly from the cylinder 194, is pivotally interconnected at its forward end to the crank arm 198. The axle 197 is transversely-disposed above and across the inlet 190, and the stop plate 196 is fixed to the portion of the axle 197 directly above the inlet 190. A pair of proximity detectors 191a, 191b (represented collectively by 191 in FIG. 24) are positioned on the inner faces of the lateral walls of the narrow channels 184a, 184b and are electrically connected to the controller 146.

The gate 192 operates in the same fashion as that of the cylinder unit 108 and stop blocks 120a, 120b, 122a, 122b. The shaft 195 begins in the retracted position. Detection of the truss plate pairs 101a, 101b by the proximity detectors 191a, 191b induces the controller 146 to actuate the air supply system 144 to extend the shaft 195, which in turn drives the crank arm 198 forwardly. Forward movement of the crank arm 198 rotates the axle 197, which in turn draws the stop plate 196 upwardly and out of the path of the truss plate pairs 101a, 101b. The shaft 195 is retracted within the cylinder 194 after the air supply system 144 receives a signal from the controller 146; the controller transmits this signal after a predetermined duration following detection of the cooperating pairs 101a, 102b by the proximity detectors 191a, 191b.

The stacking station 200 (FIGS. 5 and 9 through 14) is positioned downstream of the wide channel 188, which feeds into the stacking station 200 via an outlet 199. The stacking station 200 comprises an accumulation chamber 202, a piston assembly 212, a traveler assembly 224, and a stack carrier unit 260. The stacking station 200 receives oriented and aligned truss plates as substacks 201 (four truss plates formed into two cooperating pairs in the present embodiment), and stacks the substacks 201 into a truss plate stack 261 until a predetermined and desired number of truss plates (i.e., a sufficient number to form a truss plate bundle) has been accumulated.

As indicated in FIGS. 5 and 9A through 9C, the direction of material flow (i.e., the direction truss plates being acted upon are conveyed) in the stacking station 200 is generally perpendicular to the direction of material flow from the coil reel 32 through the stamping press 36, the orientation station 50, and the alignment station 100 to the stacking station 200. In the discussion of the stacking station 200 that follows, the downstream direction is intended to mean the direction defined by the arrows shown in outlined form in FIGS. 9B and 9C (i.e., the direction that the piston 213,of the piston assembly 212 travels as it extends, which is orthogonal to the backing members of truss plates being acted upon). The forward, longitudinal, upstream, rearward, lateral, inward, and transverse directions are as defined hereinabove relative to the newly defined downstream direction.

The accumulation chamber 202 (FIG. 9A) is defined by a lateral wall 204, the forward portion of a floor 208 that extends forwardly and rearwardly of the wide channel outlet 199, and the forward contact surface 223 of a piston 213, the movement of which is controlled by the piston assembly 212. The accumulation chamber 202 has a receiving window 207 that coincides with the wide channel outlet 199 and thereby provides a passageway for truss plate substacks 201 to enter the accumulation chamber 202. The floor 208 slopes slightly downwardly from the receiving window 207 to the lateral wall 204 to assist in the capture and retention of truss plates within the accumulation chamber 202. A proximity detector 203 is positioned at the wide channel outlet 199 and is electrically connected to the controller 146.

The piston assembly 212 (FIGS. 9A through 9C) comprises the piston 213, a cylinder 214 fixed to the rearward portion of the floor 208, a shaft 216 that extends and retracts longitudinally from within the cylinder 214, and a pair of longitudinally-extending alignment rods 217. The shaft 216 is fixed at its extendable end to the rear surface of the piston 213. Each of the alignment rods 217 is also attached at one end to the piston rear surface. A knob 218 is attached to the other end of each alignment rod 217. A pair of stop blocks 219 having longitudinal bores therein are also fixed to the rearward portion of the floor 208; the alignment rods 217 are received within these bores. One of the alignment rods 217 also carries a proximity member 227 adjacent its knob 218 which extends generally laterally a sufficient distance to be capable of detection by a proximity sensor 221 that is fixed to the floor 208 and that is electrically connected to the controller 146. In addition, a guard 215 is fixed to the rear surface 225 of the piston 213 to prevent truss plates residing at the outlet 199 from entering the accumulation chamber 202 prior to the return stroke of the piston 213. Also, a pair of grooves are present in the lower portion of the piston 213 to receive a pair of stop pins 210.

A cam driver block 211 (FIGS. 10 through 11A) is fixed to one of the alignment rods 217 to reside rearwardly from the guard 215. The cam driver block 211 is connected at its forward end to a wheeled cam follower 209. A pair of stop pins 210 extend upwardly through the floor 208 forwardly of the window 207. At their lower ends, the pins are attached to a cam block 205, which also carries a hinged cam 203 that is positioned to contact the cam follower 209. The cam block 205 includes a ridge against which the cam 203 can rest when being forwardly biased by the cam follower 209; also, the cam 203 is biased by a spring 225 toward this ridge. The lower end of the cam block 205 is attached to a vertically-directed spring 206.

The traveler assembly 224 (FIGS. 10 through 12) comprises a spring cylinder unit 228, an air cylinder unit 238, and a traveler arm 244. These components provide a backstop for the accumulating truss plate stack that travels downstream as the size of the stack expands.

The spring cylinder 228 (FIG. 10) comprises a longitudinally-extending cylinder 234 fixed to a frame 226, a shaft 230 that is extendable therefrom and retractable therein, and a spring 232 that helically encircles the rearward portion of the shaft 230. The cylinder 234 is fixed to the frame 226 to reside generally above the piston assembly 212. The spring 232 is attached at its rearward end to a dual carrier block 233 and at its forward end to the rearward end of the cylinder 234.

The air cylinder unit 238 (FIG. 10) comprises a stationary and longitudinally-oriented cylinder 240, a shaft 242 that is extendable therefrom and retractable therein, an extension member 243, and a spring 245. The extension member 243 is fixed at its rearward end to the dual carrier block 233 and at its forward end to the rearward end of the cylinder 240. The spring 245 is fixed at its rearward end to the frame 226 and extends longitudinally and generally parallel with the extension member 243 to terminate at the rearward end of the cylinder 240. The shaft 242 extends forwardly from the forward end of the cylinder 240.

The traveler arm 244 (FIGS. 10 through 12) is pivotally interconnected at its upper end with the forward end of the shaft 242 at a pivot 246, and is further pivotally interconnected at its central portion with the forward end of the extension arm 236 at a pivot 248. The traveler arm 244 extends downwardly from the pivot 248 and terminates in a rearwardly-extending finger 250 having a rearwardly-facing contact surface that is configured to abut the forwardmost truss plate in an accumulating stack.

Figure 9A:
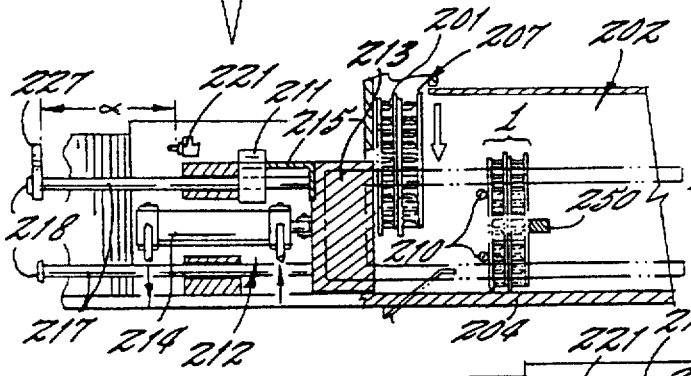
FIG. 9A is a cross-sectional plan view of a portion of the accumulation chamber and the piston assembly showing the piston in its retracted position.

In operation, a substack 201 comprising four truss plates (i.e., two cooperating pairs) enters the accumulation chamber 202 through the window 207 from wide channel 188 (FIG. 9A). As the substack 201 enters, the piston 213 is in its rearmost position, with the shaft 216 of the piston assembly 212 being retracted. The cam driver block 211 is in its rearward position; as a result, the cam follower 209 contacts the rear end of the cam 203. This enables the spring 206 to take an extended position, thereby raising the cam block 205 and, accordingly, extending the stop pins 210. The traveler assembly 224 is in its rearwardmost position; the springs 232, 243 force the mounting block 231 to a rearward position adjacent the frame 226, thus drawing the pneumatic cylinder unit 238 and the shaft 230 rearward. The shaft 242 is extended from the cylinder 240, with the result that the traveler arm 244 is generally vertically disposed.

Figure 9B:
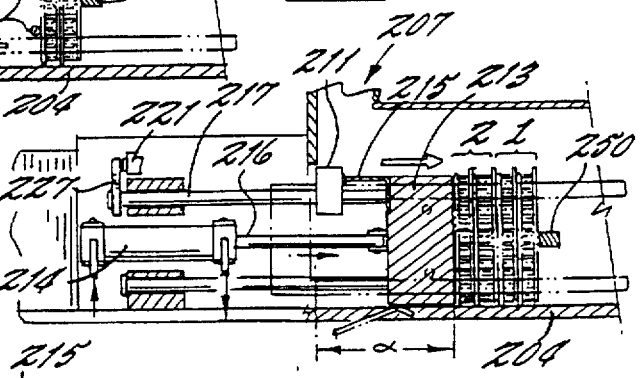
FIG. 9B is a cross-sectional plan view of a portion of the accumulation chamber and piston assembly showing the piston in its extended position.

As the truss plate substack 201 enters the window 207, the proximity detector 203 signals the controller 146 of the substack's presence. The controller 146 actuates the air supply system 144 to extend the shaft 216 of the piston assembly 212 from the cylinder 214 (FIG. 9B). This action drives the piston 213 forward so that it contacts the rearwardmost truss plate in the substack 201 and pushes the entire substack 201 forwardly.

Figures 10, 10A, 11, 11A, 12, 13, 14:
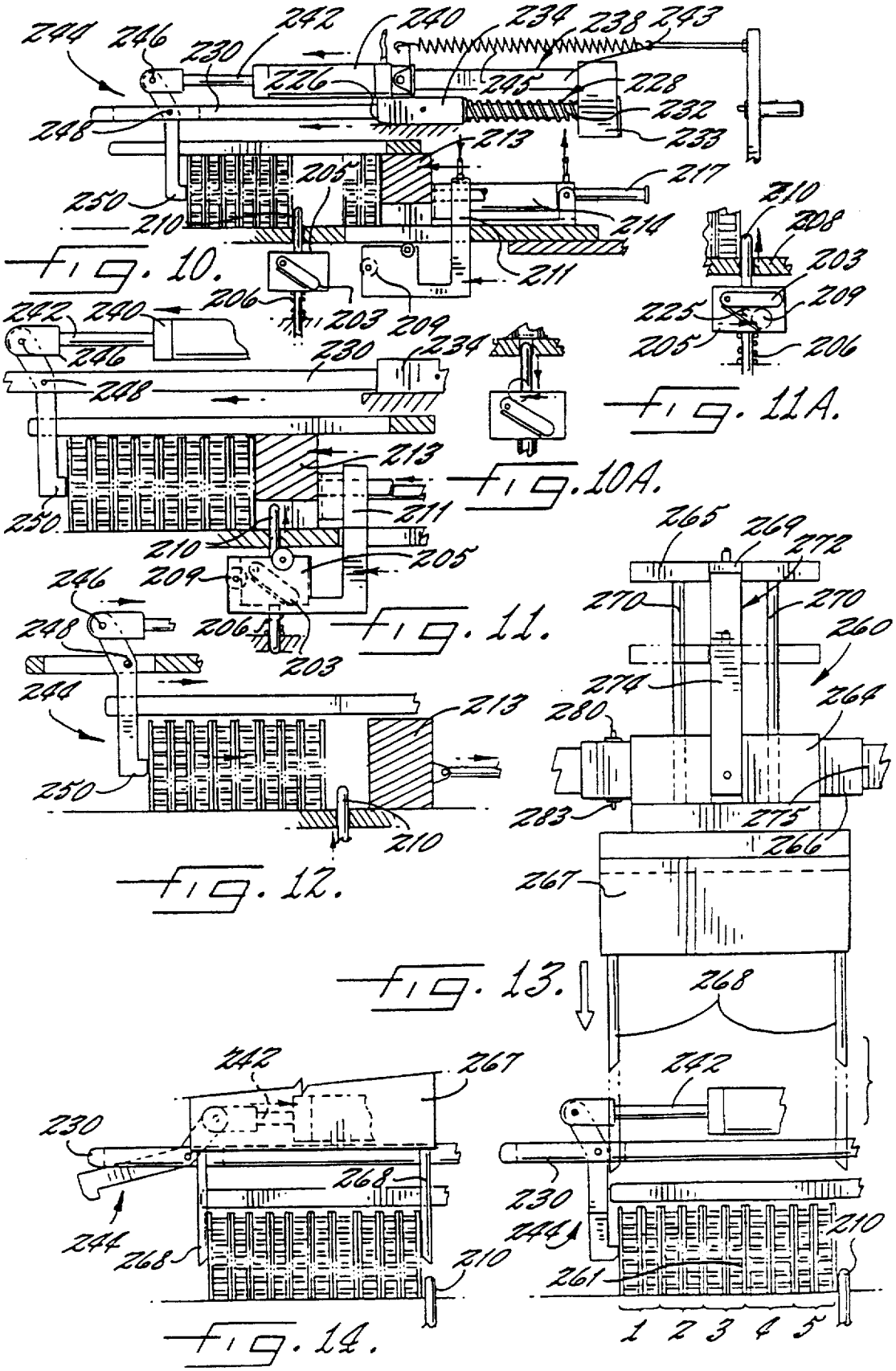
FIG. 10 is a side view of the stacking station taken along lines 10—10 of FIG. 5 showing the accumulation chamber, the piston assembly in its retracted position, and the traveler assembly in a partially extended position.
FIG. 10A is an enlarged side view of the cam block and stop pins in the retracted position with the cam follower illustrated in phantom line.
FIG. 11 is a partial cross-sectional view of the stacking station showing the piston assembly in its extended position, the stop pin in its retracted position, and the traveler assembly in its extended position.
FIG. 11A is an enlarged side view of the cam block and stop pins in the extended position, wherein the cam has pivoted to enable the cam follower, shown in phantom line, to pass therebeneath.
FIG. 12 is a partial cross-sectional view of the stacking station showing the piston moving to its retracted position, the stop pin in its extended position, and the traveler assembly moving to its retracted position.
FIG. 13 is a partial side view of the carrier assembly in its retracted position prior to its being lowered onto a truss plate stack.
FIG. 14 is a partial view of the carrier assembly taken along lines 14—14 of FIG. 15 showing the carrier assembly in its lowered position and the traveler arm of the traveler assembly in its retracted position.

As the piston 213 moves forwardly, the alignment rods 217 and cam driver block 211 attached thereto also move forwardly (FIG. 10); this forward movement of the cam driver block 211 forces the cam follower 209 forward. Forward movement of the cam follower 209 along the upper surface of the cam 203 forces the cam block 205 downwardly (FIG. 10A). As the cam block 205 moves downwardly, the stop pins 210 are also drawn downwardly into a retracted position beneath the upper surface of the floor 208. This action clears the path for the continued forward movement of the piston 213 until the forwardmost truss plate in the substack 210 contacts either the traveler arm finger 252 or the rearwardmost truss plate of the accumulating stack 261 (FIG. 9B).

The forward action of the piston 213 and accumulating truss plate stack 261 drives the traveler assembly 224 forwardly (FIG. 11); the shaft 230 slides forwardly relative to the cylinder 234 (resisted by the spring 232), and the air cylinder unit 238 moves forwardly (resisted by the spring 243) without any extension or retraction of the shaft 242 within the cylinder 240. Forward movement of the piston 213 ceases when the knobs 218 of the alignment rods 217 contact the stop blocks 219.

As the piston 213 reaches its forwardmost position (FIG. 9B), the proximity member 227 approaches the proximity detector 221, which detects the presence of the proximity member 227 and signals the controller 146 accordingly. The controller 146 then actuates the air supply system 144, which in turn operates to retract the piston 213.

In addition, full forward movement of the piston 213 drives the cam follower 209 forward of the cam 203 (FIG. 11). The absence of any vertical interference from the cam follower 209 enables the spring 206 to force the cam block 205 to rise, thereby extending the stop pins 210 within the grooves in the piston 213. The cam 203 pivots upwardly to enable the cam follower 209 to pass therebeneath (FIG. 11A); once the cam follower 209 has cleared the rearward end of the cam 203, the cam 203, biased by the spring (not shown), returns to its original position.

As the piston 213 retracts, the springs 232, 243 draw the traveler arm 244 rearwardly (FIG. 12). The traveler arm 244 pushes the accumulated truss plate stack 261 rearwardly until the rearmost truss plate strikes the extended stop pins 210; because the springs 232, 243 bias the stack 261 rearwardly, the truss plates comprising the stack 261 are slightly compressed and thus do not dissociate during the accumulation thereof.

Figure 9C:
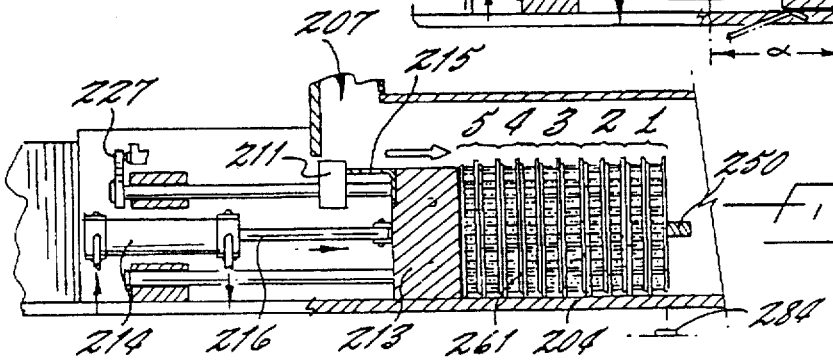
FIG. 9C is a cross-sectional plan view of a portion of the accumulation chamber and piston assembly showing the piston in its extended position with a full stack of truss plates having been accumulated.

Once the piston 213 has retracted completely, the accumulation chamber 202 is able to receive the next substack 201 to add to the truss plates already present in the stack 261. This set of steps is repeatedly performed until a predetermined number of truss plates, such as the twenty truss plates illustrated in the present embodiment, is stacked (FIG. 9C).

Those skilled in this art will appreciate that, although the illustrated stacking station 200 is preferred, other means of receiving substacks of truss plates and stacking them into a suitably sized stack for subsequent interconnection can also be employed with the present invention. For example, articulating arm units that can grasp a substack of oriented and aligned truss plates and move them to a stacking receptacles can be used. Also, alternative configurations for the accumulation chamber 202, the piston assembly 213, and the traveler assembly 224 can be employed. It is preferred that the accumulation chamber 202 be oriented relative to the conveying unit providing truss plates thereto such that the truss plates are conveyed in a direction generally parallel to their backing members. It is also preferred that the piston assembly 213 or other means for conveying the substacks of truss plates to be stacked convey them in a direction generally orthogonal to the truss plate backing members, as this can facilitate the stacking process.

Although the illustrated piston assembly 213 is preferred, other means for conveying truss plate substacks to an accumulating stack can be used. For example, an articulating arm unit, a pneumatically-driven forced air unit, a pivoting slider-crank mechanism, or the like can be used in lieu of the illustrated piston assembly 213 to convey truss plate substacks from their entry point in the accumulation chamber 202 to the backstop of the accumulation chamber 202 provided by the traveler assembly 224.

The traveler assembly 224 can be alternatively constructed with a pneumatically-driven unit that retracts as the truss plates are conveyed forwardly and either remains stationary or extends rearwardly on the return stroke of the piston. In addition, other suitable configurations for the traveler assembly can be used. For example, a ratcheting-type configuration that extends forwardly to accommodate each additional truss plate substack added. Alternatively, a longitudinally-disposed set of synchronized chains, each of which rotates about a pair of sprockets, can also be employed. The chains would receive the stacking truss plates in a space defined by adjacent opposing chain links. Such chains include stop members on certain chain links. Other suitable mechanical and pneumatic configurations for the traveler assembly will become apparent to those skilled in this art. Irrespective of the configuration employed, it is preferred that the traveler assembly or its equivalent be configured so that it can be retracted once a complete stack of truss plates is formed to facilitate removal of the stack therefrom.

It is also preferred that the stacking station 200 be configured, as illustrated, so that, as truss plate substacks are being stacked, the accumulated truss plates are compressed to reduce the tendency of individual truss plates to dissociate from the stack. It is also preferred that any means for compressing the stack, such as the spring-loading of the traveler assembly 224 and the extendable stop pins 210, be operatively coupled to the piston assembly 213 to enhance operation of the stacking process.

After the desired number of truss plates have been stacked into a truss plate stack 261, the stack carrier unit 260 conveys the stack 261 away from the accumulation chamber 202 to the banding station 300. The stack carrier unit 260 (FIG. 13) comprises a carrier 264 that is both horizontally and vertically translatable relative to a stationary frame 262. Vertical movement of the carrier 264 is controlled by a vertically-disposed pneumatic cylinder assembly 272 and by a horizontally-disposed rodless cylinder assembly 275. The carrier 264 includes a traveler block 266 that is fixed to the piston (not shown) of the rodless cylinder assembly 275 and a capture block 267 that is attached to the shaft of the vertically-disposed pneumatic cylinder assembly 272. A pair of guide rods 270 extend upwardly from the upper surface of the capture block 267, extend through a pair of bores in the traveler block 266, and attach to an upper bar 265. The upper bar 265 includes a groove 269. A vertical guide bar 274 is received within the groove 269 and extends downwardly to meet the traveler block 266; the vertical guide bar 274 is substantially parallel with and lateral of the cylinder of the vertically-disposed air cylinder assembly 272. Four prongs 268 (two are shown in FIGS. 13 and 14) extend downwardly from the lower surface of the capture block 267; the prongs 268 are spaced away from each other a sufficient distance to capture the downstream and upstream faces of the truss plate stack 261. The capture block 267 also includes a vertical groove originating at its lower face and extending upwardly in which the air cylinder unit 238 and the spring cylinder unit 228 can reside without interference therebetween.

Figures 15, 16:
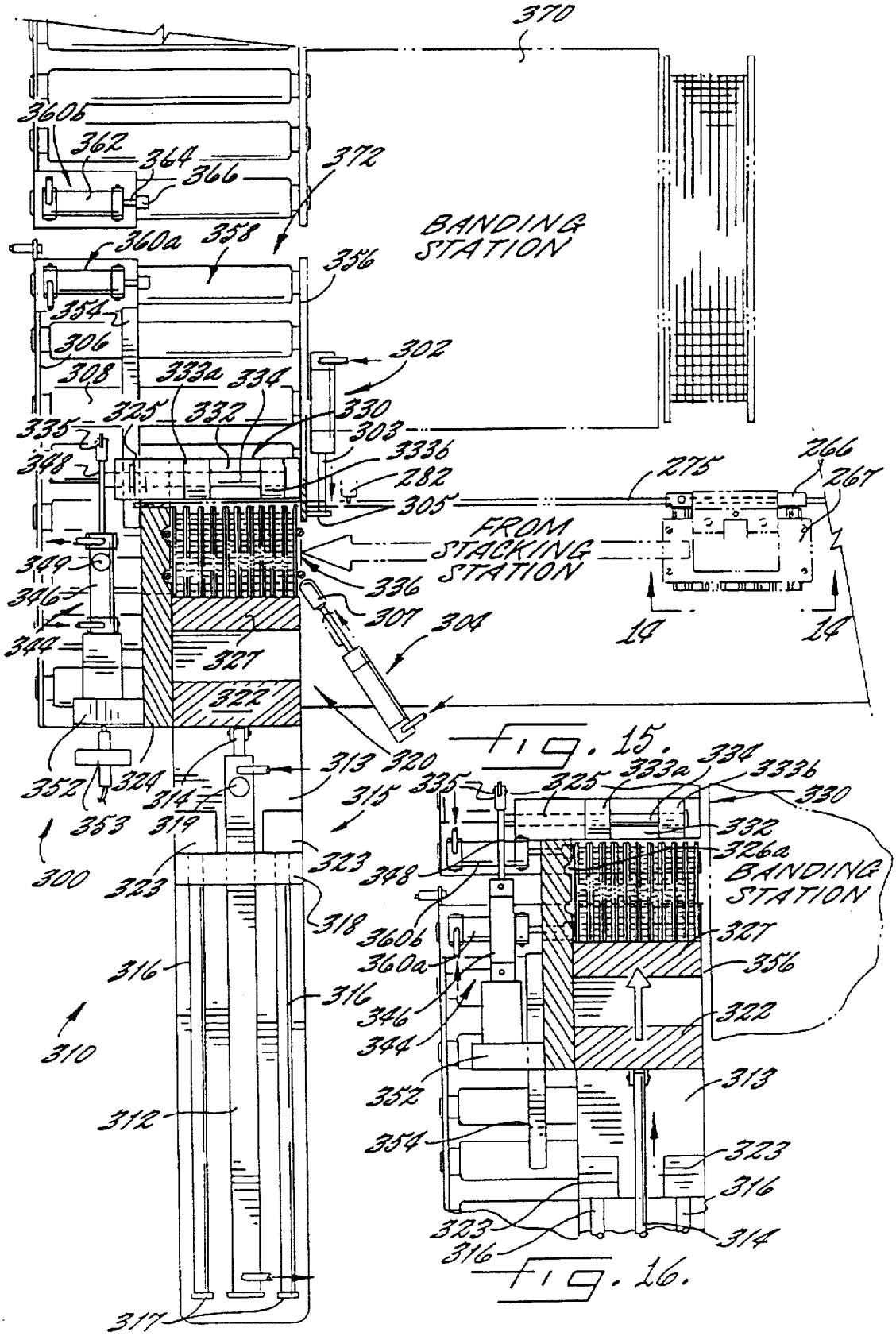
FIG. 15 is a partial sectional view taking along lines 15—15 of FIG. 1 showing the stacking station and the banding station, with the banding station piston assembly in its retracted position, the front wall in its lowered position, and the clamping cylinders in their retracting positions.
FIG. 16 is an enlarged partial sectional view of the banding station of the banding station piston assembly in its extended position and the clamping cylinders in their extending positions.

As stated above, the traveler block 266 is fixed to the piston of the rodless cylinder assembly 275 (FIG. 14). The rodless cylinder assembly 275 extends longitudinally from a position above the accumulation chamber to a position adjacent the banding station 300 (FIG. 15). A proximity detector 280 (FIG. 14) is fixed to the upper surface of the traveler block 266 beneath the upper bar 265; the proximity detector 280 is electrically connected to the controller 146. A second proximity detector 283 is mounted to the lower surface of the traveler block 266 and is electrically connected to the controller 146.

The stack carrier unit 260 also two other proximity detectors that assist in controlling its motion. One of these, a proximity detector 282, is located on the forwardmost end of the rodless cylinder 275 (see FIG. 15). The other is a proximity detector 284, which is located in the lateral wall 204 of the accumulation chamber 202 and which is electrically connected to the controller 146 (FIG. 9C). The proximity detector 284 induces the extension of the traveler arm 244 to a position in which substacks can be accumulated in the accumulation chamber 202.

Operation of the stack carrier unit 260 is not initiated until the desired number of truss plates has been received and stacked in the accumulation chamber 202 (FIG. 13). As truss plates are collected in the accumulation chamber 202, the carrier 264 is in its upper and rearward position; the vertical cylinder 272 is retracted, and the piston of the rodless cylinder 275 is in its rearwardmost position. Once the proximity detector 221 has detected the presence of the proximity member 227 a predetermined number of times (five times for the present embodiment), it signals the controller 146, which in turn actuates the air supply system 144 to extend the shaft of the vertical cylinder 272. Such extension drives the capture block 267 downwardly from the traveler block 266 so that the prongs 268 capture the truss plate stack 261 positioned directly below. As the capture block reaches its lowermost position, the proximity detector 280 detects the presence of the upper bar 265 and signals the controller 146, which in turn activates the air supply system 144 to force the piston of the rodless cylinder 275 forwardly. Forward movement of the piston of the rodless cylinder 275 drives the traveler block 266 and the capture block 267 forward to the banding station 300. At the same time, the controller 146 activates the air supply system 144 to retract the shaft 242 of the cylinder 240; such retraction draws the finger 250 of the traveler arm 244 upwardly and forwardly and therefore out of the forward path of the capture block 267 (FIG. 14).

During the forward movement of the traveler block 266, the proximity detector 284 (FIG. 9C) detects the presence of the capture block 267 and signals the controller 146. The controller 146 activates the air supply system 144 to extend the shaft 242 from its corresponding cylinder 240. This action drives the finger 250 of the traveler arm 244 rearwardly and downwardly into position to receive additional truss plate substacks.

As the capture block 267 completes its delivery of the stack 261 to the banding station 300 (FIG. 15), the proximity detector 282 detects the presence of the traveler block 266 and signals the controller 146. The controller 146 then activates the air supply system 144 to retract the vertical cylinder 272, thereby raising the capture block 267 from the stack 261. As the capture block 267 reaches its uppermost position, the proximity detector 283 detects the capture block 267 and signals the controller 146 to activate the air supply system 144 in order to move the piston of the rodless cylinder 275 rearwardly. This movement causes the traveler block 266 and the capture block 267 to return to their initial upward and rearward positions (FIG. 13).

Those skilled in this art will appreciate that, although the illustrated carrier assembly 260 is preferred, other configurations for conveying a stack of truss plates from the stacking station 200 can also be employed with the present invention. For example, an articulating arm unit able to grasp a stack of truss plates and deliver it to a point remote from the stacking station can be used. The carrier assembly 260 can be configured so that its movement is controlled by a mechanically- or electromagnetically-driven unit. It is preferred that the carrier assembly 260 or other stack conveying means be operatively coupled to the stacking station 200 such that structures contained therein, such as the traveler assembly 260, are retracted prior to the conveyance of the stack to the banding station in order to reduce the risk of these components interfering with one another during operation.

The banding station 300 includes a piston assembly 310 and a banding unit 370 (FIG. 15). The banding station 300 receives a truss plate stack 261 from the carrier assembly 260, conveys it via the piston assembly 310 to the banding unit 370, and there wraps a strap 374 around it to interconnect, and therefore unitize, the truss plates of the stack 261 into an easily handled truss plate bundle 378. In the description that follows, the downstream direction is the direction that the truss plate stack 261 is conveyed by the piston assembly 310 toward the bander 370 (i.e., the horizontal direction generally parallel to the backing members of the truss plates comprising the stack 261). The downstream, forward, rearward, longitudinal, lateral, inward, and transverse directions have the same relative relationships to the just-defined downstream direction as set forth hereinabove.

The piston assembly 310 comprises a cylinder 312, a shaft 314, and the piston compartment 320 (FIG. 15). The piston assembly 310 is mounted on a longitudinally-disposed downwardly-tilted frame 306, on which free rollers 308 are transversely mounted. The cylinder 312 is longitudinally mounted to the rearmost portion of the frame 306. A stop block 318 is transversely fixed to the frame 306, and the cylinder 312 extends through a bore therein. The shaft 314, which extends and retracts forwardly from the cylinder 312, is attached to a carrier block 315 that comprises a wall 322 and a floor 313 fixed rearwardly thereof. Two stop columns 323 rise from the rearward portion of the floor 313 and are disposed laterally from the cylinder 312 and the shaft 314. A guide rod 316 is fixed to and extends rearwardly from each of the stop columns 323; in so extending, each guide rod 316 extends through a bore in the stop block 318. At their rearward ends, each guide rod terminates in a knob 317. A proximity detector 319 is attached to the forward end of the cylinder 312 and is electrically connected to the controller 146.

The piston compartment 320 (FIG. 15) is defined by a transversely-disposed rear wall 327, a longitudinally-disposed side wall 324 that extends rearwardly beyond the rear wall 327 to fixedly attach to the wall 322, a front wall 332, and rollers 308. The rear wall 327 is longitudinally adjustable relative to the side wall 324 so that truss plates of different lengths can be received therein. The side wall 324 includes a pair of vertical prong recesses 326*a*, 326*b* in its inner surface that receive the prongs 268 of the carrier 264.

The front wall 332 (FIG. 15) is part of a front wall assembly 330 that functions to retract the front wall 332 when necessary during operation. The front wall 332 includes a pair of tabs 333*a*, 333*b* on its upper surface and a transversely-directed shaft 334 fixed thereto. The shaft 334 extends laterally through and is rotatable within a bore in a bearing block 325 that extends upwardly from the front portion of the side wall 324. The shaft 334 then terminates with an upwardly-extending crank arm 335.

The crank arm 335 (best seen in FIG. 17) is pivotally attached to the shaft 348 of a pneumatic cylinder assembly 344 which also comprises a longitudinally-directed cylinder 346. The cylinder 346 (FIGS. 15 through 17) is fixed to a mounting block 352 that extends laterally from a rear portion of the side wall 324. The shaft 348 is pivotally interconnected with the terminal end of the crank arm 335 at a pivot 342. Retraction of the shaft 348 into the cylinder 346 causes the crank arm 335 to rotate the front wall shaft 334 relative to the bearing block 325, thereby raising the front wall 332. A proximity detector 349 is mounted on the forward end of the cylinder 396 and is electrically connected to the controller 146. An additional proximity detector 353 is mounted to the frame 306 rearwardly of the cylinder assembly 344 and is electrically connected to the controller 146.

The piston compartment 320 also includes a window 336 (FIG. 15) that provides an opening through which the truss plate stack 261 can enter. Once inside the piston compartment 320, the truss plate stack 261 is retained in its stacked configuration by a pair of pneumatic cylinder units. A longitudinally-disposed forward retention cylinder unit 302 (FIG. 15) is fixed to the frame 306; its shaft 303 is fixed to a sliding wall 305 that can cover the forward portion of the window 336 and thereby retain the truss plate stack 261 in the piston compartment 320. A longitudinally and inwardly extending rear retention cylinder assembly 304 is mounted to the frame 306 and provides a stopper 307 that fills a rear portion of the window 336 to provide additional retention reinforcement.

The rollers 308 (FIG. 15) lead to the banding unit 370. A stationary guide wall 354 extends longitudinally over the rollers 308 just lateral of the side wall 324. Another stationary guide wall 356 extends generally parallel to the guide wall 354 on the opposite transverse edge of the rollers 308. These two guide walls 354, 356 and the rollers 308 define a channel 358 within which the truss plate stack 261 is conveyed by the piston assembly 310 to the banding station 370 by the piston assembly 310.

The banding unit 370 (FIGS. 15 and 16) is mounted adjacent and lateral of a gap 372 that exists between two of the rollers 308 downstream from the piston assembly 310. The banding unit 370 is configured to wrap a strap 374 around adjacent peripheral edges of the truss plate backing members of the truss plates in a stack 261 and to connect the ends of the strap 374 to form a tight loop, thereby producing a unitized truss plate bundle 378. Those skilled in this art will appreciate that any banding unit that can form a loop around the truss plate stack to form a unitized bundle 378 can be used with the present invention.

A pair of clamping air cylinder assemblies 360*a*, 360*b* (FIGS. 16 and 17) are positioned laterally from the gap 372 opposite the banding unit 370. Each of the clamping cylinder assemblies 360*a*, 360*b* comprises a transversely-oriented cylinder 362, a shaft 364 that is extendable therefrom and retractable therein, and a cushioning pad 366 located at the free end of the shaft 364. These cylinder assemblies 360*a*, 360*b* are mounted and configured to compress the truss plates of the truss plate stack 261 together so that a more compact stack is presented for strapping by the banding unit 370.

In operation, the banding station 300 receives the truss plate stack 261 from the stacking station 200 via the stack carrier unit 260. When receiving the truss plate stack 261, the shaft 314 of the piston assembly 310 is in its retracted position (FIG. 15). The shaft 348 of the cylinder assembly 344 is retracted, thereby retaining the front wall 332 in its lowered position. The clamping cylinders 360*a*, 360*b* are both in their respective retracted positions. The forward and rear retention cylinder assemblies 304, 306 are in their respective extended positions.

As the carrier 264 slides the truss plate stack 261 forwardly, it passes the proximity detector 280, which signals the controller 146. The controller 146 activates the air supply system 144 to extend the shafts of the forward and rear retention cylinder assemblies 304, 306 (shown in phantom line in FIG. 15). The retraction of these shafts opens access to the piston compartment 320 through the window 336. As the carrier 264 proceeds and completes its forward motion, the presence of the traveler block 266 is detected by the proximity detector 282, which signals the controller 146. The controller activates the air supply system 144 to extend the forward and rear retention cylinder assemblies 304, 306 and, after a slight time delay, to raise the capture block 267. These actions retain the truss plates of the stack 261 in their stacked configuration and remove the capture block 267 and prongs 268 so that the piston compartment 320 can be conveyed forwardly. As the capture block 267 reaches its uppermost position, it is detected by the proximity detector 283, which activates the air supply system 144 (through the controller 146) to extend the shaft 314 of the piston assembly 310 and thereby convey the stack 261 forwardly.

Figure 17:
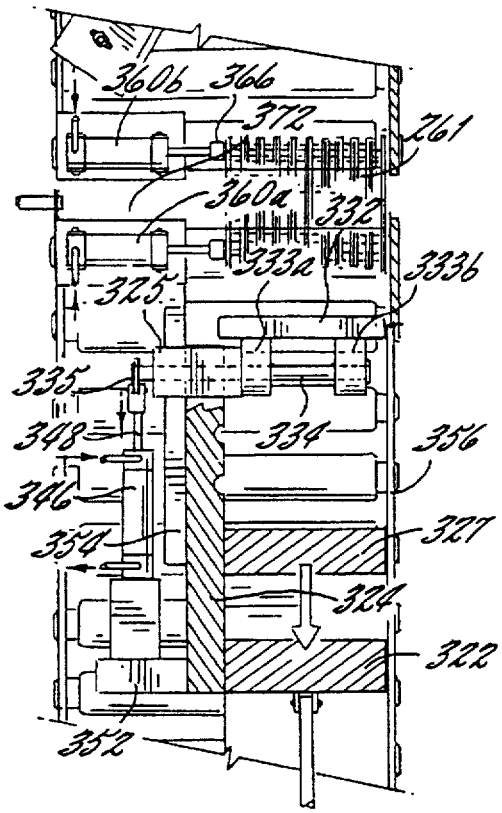
FIG. 17 is an enlarged partial sectional view of the banding station showing the piston assembly retracting, the front wall in its raised position, and the clamping cylinders in their extended positions.

As the piston compartment 320 moves forwardly to a point above the gap 372 in the rollers 308 (FIG. 16), the proximity detector 319 detects a steel insert (not shown) located on the rearward end of the shaft 314 that the shaft 314 is fully extended and signals the controller 146 accordingly. The controller 146 activates the air supply system 144 to extend the clamping cylinders 360*a*, 360*b* and therefore retain and compress the truss plate stack 261. The controller 146 also activates the air supply 144 to retract the shaft 348 of the cylinder. 344; this action draws the crank arm 335 rearwardly and causes the shaft 334 to rotate. Rotation of the shaft 334 within the bearing block 325 raises the front wall 332 (FIG. 17).

Figure 18:
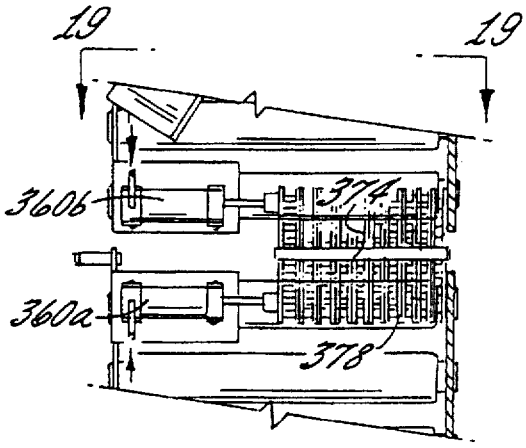
FIG. 18 is a partial sectional view of the banding station showing truss plates formed into a truss plate bundle.

As the shaft 348 fully retracts (FIG. 17), the proximity detector 349 detects a steel insert (not shown) located in the front end of the shaft 348 and signals the controller 146 to activate the air supply system 144 to retract the shaft 314 of the piston assembly 310. Once the shaft 314 is fully retracted, thereby returning the piston compartment 320 to its original position, the proximity detector 353 detects the presence of the mounting block 352 and signals the controller 146 to activate, through the air supply system 144, the extension of the shaft 348, which lowers the front wall 332. This same signal from the proximity detector 353 also induces the controller 146 to activate the banding unit 370. The banding unit wraps a strap 374 around the truss plate stack 261 to form a truss plate bundle 378 therefrom (FIG. 18). In addition, the same signal from the proximity detector 353 induces the controller 146, after a predetermined delay period, to activate the air supply system 144 to retract the shafts 364 of the clamping cylinder assemblies 360*a*, 360*b*. When released by the clamping cylinders 360*a*, 360*b*, the truss plate bundle 378 rolls on the rollers 308 to the offloading station 400.

Those skilled in this art will appreciate that, although the illustrated configuration for the banding station 300 is preferred, other means for interconnecting the truss plates comprising a truss plate bundle can also be employed with the present invention. For example, the truss plates can be interconnected, and thus unitized, with a heat-shrinkable polymer film, or with a stiff wire threaded through the apertures in the truss plates. Further, the configuration of the piston assembly 310 can vary; the piston 314 can be conveyed to the banding station 370 via a mechanical linkage, an electromagnetically-driven cylinder, or the like. It is preferred that the piston assembly 310 or other conveying means be operatively coupled to the banding unit 370, and it is further preferred that any unit designated to raise the front wall 332 be operatively coupled to the piston unit to reduce the risk that the front wall 332 raises or lowers untimely. Those skilled in this art will also recognize that the clamping cylinders 360*a*, 360*b* can be omitted, although it is preferred that they be included to enable a tighter bundle to be produced.

Figure 19:
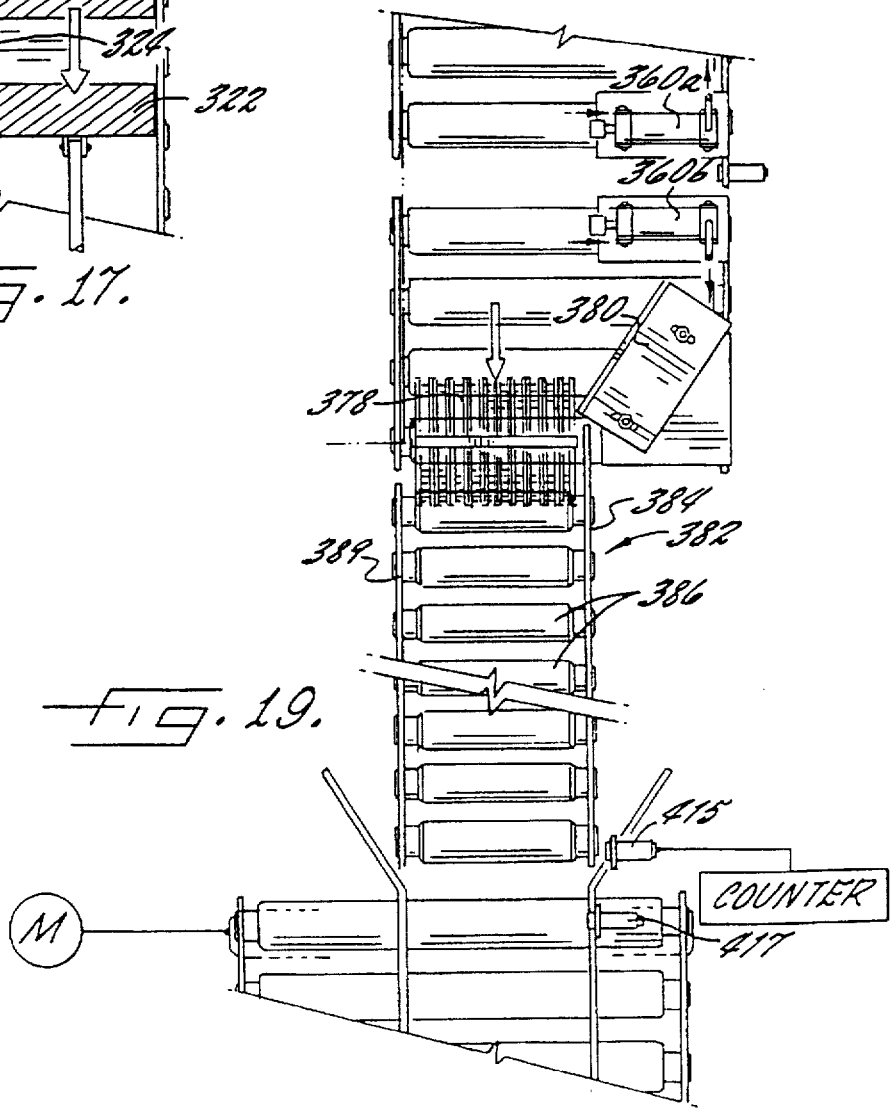
FIG. 19 is a partial end view taken along lines 19—19 of FIG. 18 showing the channel conveyor leading from the banding station to the offloading station.

A channel conveyor 382 leads from the banding unit 370 to the offloading station 400 (FIG. 19). An angled bumper 380 is positioned downstream of the banding unit 370 to encourage truss plate bundles 378 to be conveyed into the channel conveyor 382 without twisting or turning. The channel conveyor 382 is defined by a pair of guide walls 388, 389 and rollers 386, each of which is mounted to a frame 384. The mouth of the channel conveyor 382 is positioned at the downstream end of the bumper 380. Two proximity detectors 401, 403 are positioned laterally from the channel conveyor outlet and are electrically connected to a controller 440.

The channel conveyor 382 leads to the offloading station 400, which comprises a bundle row accumulator 402 (FIG. 20) and a bundle lifter 410 (FIGS. 20 through 23). The bundle row accumulator 402 (FIG. 20) comprises a plurality of transverse drive rollers 406 mounted on a frame 408 and connected to an external motor 421, a lateral side wall 404 mounted above the rollers 406, a lateral side wall 405 comprising a shunt 407 and a retractable wall 409, and an end wall 411. A pair of proximity detectors 415, 417 are positioned at the upstream end of the row accumulator 402. These proximity detectors are electrically connected to a controller 403. The controller 403 is also connected to an air supply 419.

The bundle lifter 410 (FIG. 23) comprises a programmable control unit 413, an articulating arm 420 connected thereto, and a pair of opposed gripper plates 412, 414 (FIGS. 20 through 22) that reside above each lateral edge portion of the rollers 406. The control unit 413, which is electrically connected to the controller 403, can be any known to those skilled in this art to control the movement of an articulating arm or other conveying means such that the arm grasps a row of truss plate bundles and conveys it to a predetermined position that is updated for each row of truss plate bundles. The gripper plate 412 includes a gripper pad 416 on its inner surface. A pair of retracting cylinders 418*a*, 418*b* are mounted transversely on the frame 408 and are interconnected with the retractable wall 409. These cylinders 418*a*, 418*b* are fluidly connected to the air supply 417. The articulating arm 420 is configured to extend to a pallet 422 positioned laterally from the row accumulator 402 and to place rows of truss plate bundles thereon in a stacked array 424.

Figure 20:
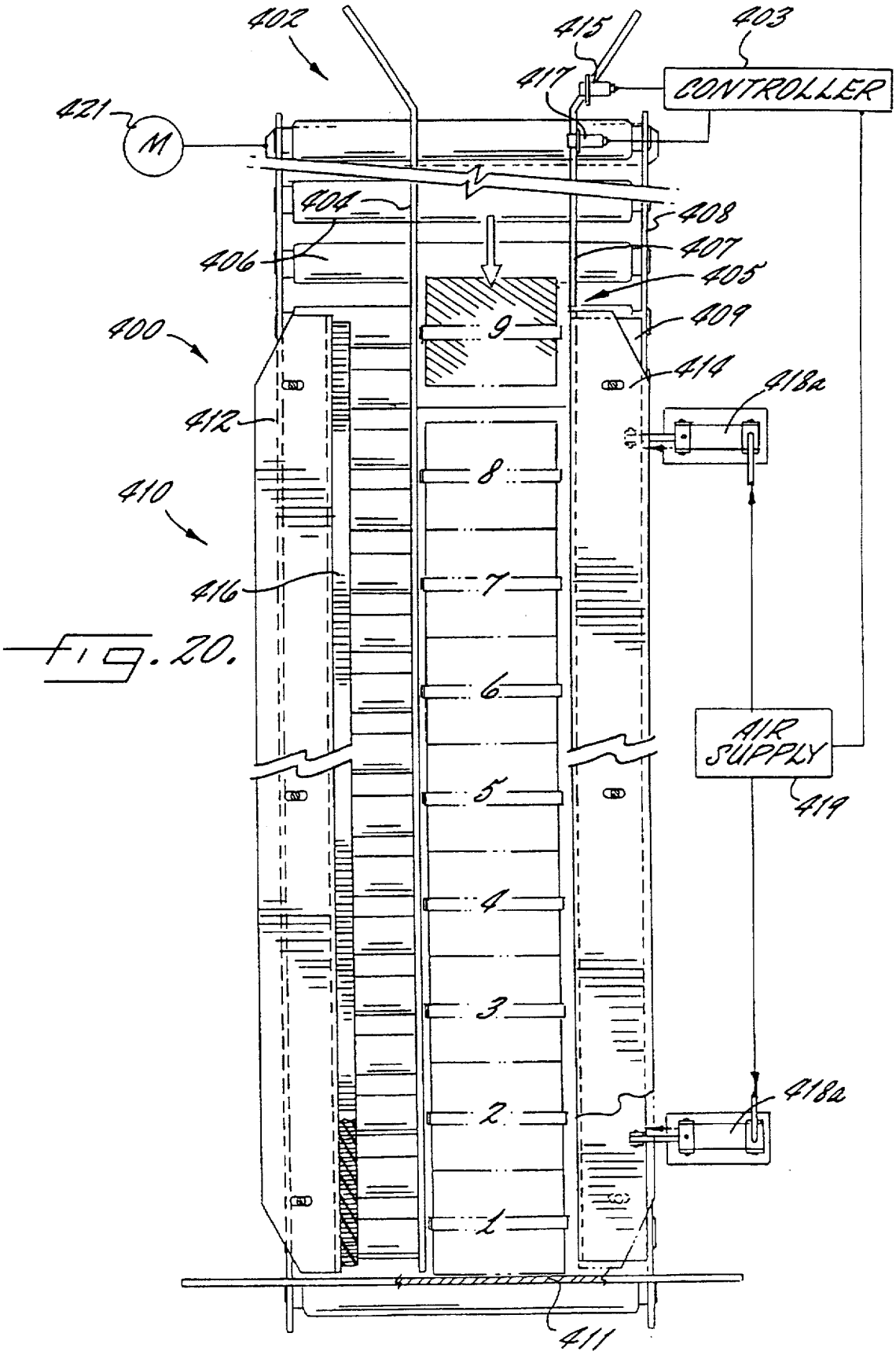
FIG. 20 is a plan view taken along the lines 20—20 of FIG. 1 showing the offloading station.
Figure 21:
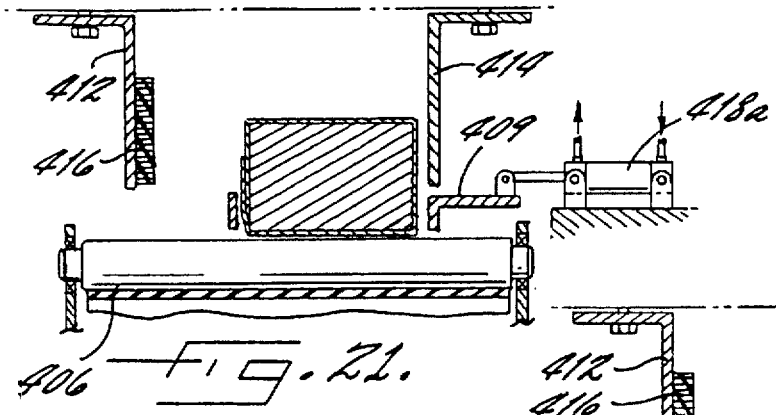
FIG. 21 is a cross-sectional end view of the offloading station showing the retractable wall in its extended position and the gripper plates in their retracted positions.

In operation, the offloading station 400 receives truss plate bundles 378 from the channel conveyor 382 (FIG. 20). As the truss plate bundles 378 are being received, the retractable wall 409 is in its extended position so that the bundles 378 do not twist, turn, tumble, or otherwise become re-oriented within the row accumulator 402 (FIG. 21). The gripper plates 412, 414 are in their respective retracted positions.

Figure 22:
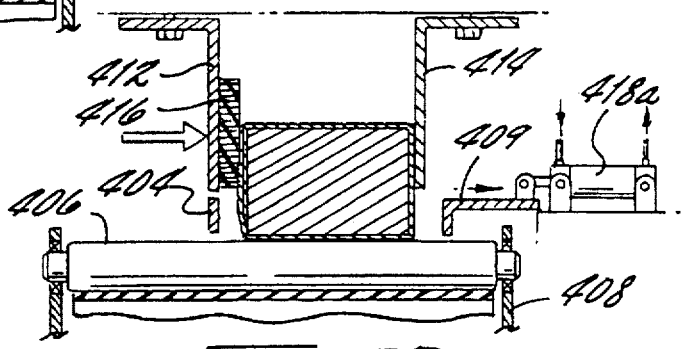
FIG. 22 is a cross-sectional end view of the offloading station showing the retractable wall in its retracted position and the gripper plates in their extended gripping positions.
Figure 23:
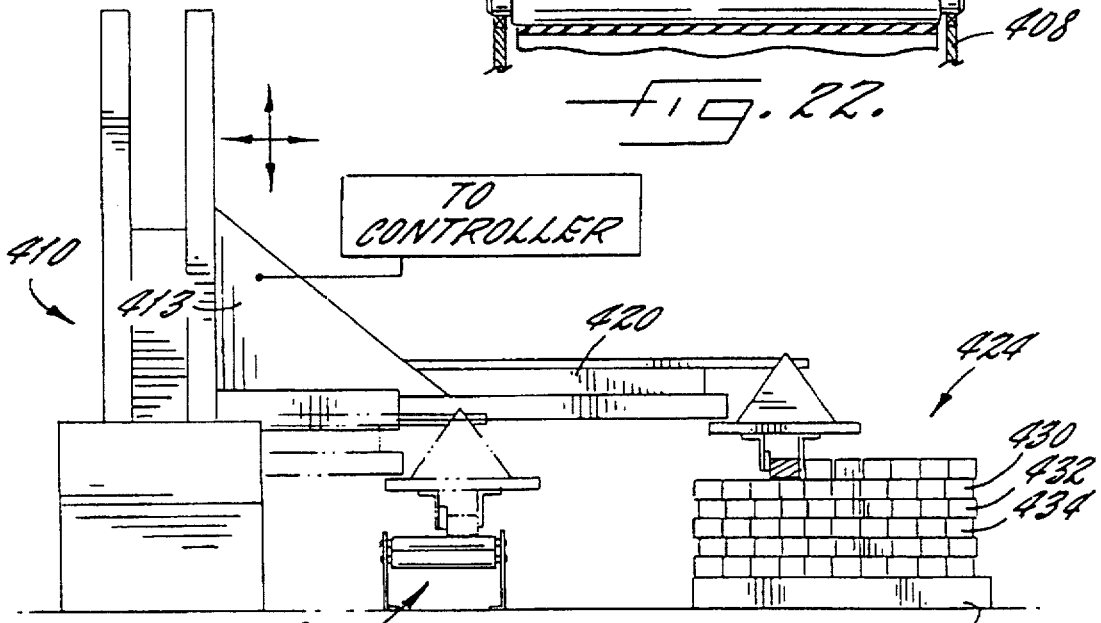
FIG. 23 is an end view of the offloading station showing the offloading of rows of truss plate bundles onto a pallet to form a stacked array.

The proximity detector 415 counts the bundles 378 as they enter into the row accumulator. Once a predetermined number of bundles 378 have been counted, the proximity detector 415 signals the controller 403. The controller 403 signals the air supply 417 to retract the retracting cylinders 418*a*, 418*b*, which action retracts the retractable wall 409 (FIG. 22). In addition, the controller 403 activates the control unit 413, which lowers its arm 420, moves the gripper plates 412, 414 to contact and grasp the truss plate bundles 378 in the row accumulator 402, lifts the grasped bundles from the row accumulator 402, and conveys them to and releases them at a predetermined location on the pallet 422 (FIG. 23). After a time delay, the cylinders 418*a*, 418*b* extend, thereby repositioning the retractable wall 409 to its original position. The control unit 413 guides the articulating arm 420 back to its original position, with the gripper plates 412, 414 returning to their open position.

As the articulating arm 420 is grasping a row of truss plate bundles 378 and conveying the truss plate bundles to the pallet 422, the proximity detector 417 (FIG. 20) continues to scan the inlet of the row accumulator 402 for approaching truss plate bundles 378. If any are detected prior to the extension of the retractable wall 409, the proximity detector 417 signals the controller 403, which in turn disengages the motor 421 to the drive rollers 406. The motor 421 is reactivated after the retractable wall 409 extends.

Preferably, the stacked array 424 comprises a plurality of truss plate bundles 378 arranged in a plurality of vertical layers 430, 432, 434 (FIG. 23). The bundles 378 are oriented so that all of the truss plate backing members contained therein extend in an upright plane. The bundles 378 of each bundle layer 430, 432, 434 are illustratively and preferably arranged to be offset to the bundles of an adjacent layer, and should be so offset so that the backing member of the endmost truss plate of a bundle in one layer 430 resides between planes defined by the backing members of truss plates of bundles in an adjacent layer 432. In this arrangement, the lower edges of at least some of the truss plates of an adjacent upper layer can, due their own weight and the weight of layers above them, be forced into the space between the upper edges of the backing members of the truss plates comprising the adjacent lower layer; simultaneously, the upper edges of two plate backing members of the lower layer are forced between the backing members of the truss plates of the adjacent upper layer. The interpositioning of the backing members resists movement of the bundles relative to one another, particularly in a direction normal to that of the planes defined by truss plate backing members, and thereby provides the stacked array 424 with significant stability against toppling. The bundles of layer 434 are then positioned directly below the bundles of layer 432 so that the same positional relationship is retained between adjacent layers 430, 432. Preferably, the bundles of adjacent layers 430, 432 are offset so that the backing member of each endmost truss plate of bundles in one layer 430 resides between the backing members of the truss plates that are third and fourth from the end of the bundle in an adjacent layer; i.e., the endmost backing member of the adjacent layer resides between the planes defined by the backing members of the couplet adjacent the endmost couplet of that bundle. However, the bundles of one layer may simply contact the bundles of an adjacent layer (i.e., the bundle layers are not offset) and still resist collapsing.

The foregoing description and drawings illustrate a system for the packaging of truss plates in bundles with automated equipment. This system can be employed to produce truss plate bundles far more quickly and efficiently than can be done by hand. As such, truss plate bundles become a much more commercially viable product, and the shipping, storage, and handling advantages inherent to the packaging of truss plates in bundles can be realized.

The foregoing embodiment is illustrative of the present invention, and is not to be construed as limiting thereof. The invention is defined by the following claims, with equivalents of the claims to be included therein.

That which is claimed is:

1. An apparatus for aligning a pair of separate truss plates, each of said truss plates comprising a generally planar backing member and a plurality of impaling members extending from one side thereof, so that the peripheries of the backing members of each of the truss plates are substantially aligned, said apparatus comprising:

conveying means for conveying the pair of separate truss plates from an of orienting unit in which the truss plates are oriented so that their backing members are substantially parallel to a predetermined plane;

retractable stop means for halting the movement of each of the truss plates in a respective predetermined position, the predetermined positions being selected so that cessation of movement of the truss plates in the respective predetermined positions causes the peripheries of the truss plate backing members to be substantially aligned, said stop means being movable between an extended position, in which said stop means engages and halts movement of said truss plates as they reach their respective predetermined positions, and a retracted position, in which said stop means fails to engage said truss plates; and directing means for directing the pair of oriented and substantially aligned truss plates into contacting relationship in which the impaling members of each truss plate of the pair extend toward the backing member of the other truss plate of the pair.

2. The apparatus defined in claim 1, wherein said stop means is configured so that the peripheries of said backing members are offset longitudinally sufficiently so that said truss plates can form a nesting cooperating pair without interference between opposing impaling members.

3. The apparatus defined in claim 1, further comprising drive means for driving said truss plates from said aligning means.

4. The apparatus defined in claim 3, wherein said drive means comprises a drive wheel that engages upper edges of said truss plates of said pair.

5. The apparatus defined in claim 3, further comprising means for operatively coupling said drive means and said stop means so that retraction of said stop means actuates said drive means to drive said truss plates from said stop means, and so that extension of said stop means disengages said drive means.

6. The apparatus defined in claim 3, wherein said directing means is operatively coupled to said drive means such that actuation of said drive means to engage said truss plates accompanies actuation of said directing means.

7. The apparatus defined in claim 1, wherein said directing means is operatively coupled to said stop means such that retraction of said stop means to the retracted position accompanies actuation of said directing means.

8. The apparatus defined in claim 2, wherein said retractable stop means is configured to halt the movement of truss plates having backing members with a plurality of elongated apertures therein, wherein the impaling members of each of said truss plates are arranged in pairs, with one of said impaling members of the pair being positioned adjacent one end of an aperture, and the other impaling member being positioned at an opposite end of the aperture, such that said directing means directs truss plates so configured to form nesting cooperating pairs without interference between opposing impaling members.

9. The apparatus defined in claim 8, wherein the truss plates include impaling members arranged in a staggered pattern, and wherein said stop means is configured to halt the movement of such truss plates so that, as said directing means directs pairs of truss plates into nesting cooperating pairs, the impaling members of opposed truss plates fail to interfere with each other.

10. The apparatus defined in claim 1, further comprising position-detecting means operably associated with said stop means, said position-detecting means being configured to detect the presence of a truss plate in a predetermined position and to actuate the retraction of said stop means from the extended position to detection of a position upon detection of a truss plate in said predetermined position.

11. An apparatus for aligning a pair of separate truss plates, each of said truss plates comprising a generally planar backing member and a plurality of impaling members extending from one side thereof, so that the peripheries of the backing members of each of the truss plates are substantially aligned, said apparatus comprising:

a conveyor for conveying the pair of separate truss plates from an orienting unit in which the truss plates are oriented so that their backing members are substantially parallel to a predetermined plane;

a retractable stop unit for halting the movement of each of the truss plates in a respective predetermined position, the predetermined positions being selected so that cessation of movement of the truss plates in the respective predetermined positions causes the peripheries of the truss plate backing members to be substantially aligned, said stop unit being movable between an extended position, in which said stop unit engages and halts movement of said truss plates as they reach their respective predetermined positions, and a retracted position, in which said stop unit fails to engage said truss plates; and a directing unit for directing the pair of oriented and substantially aligned truss plates into contacting relationship in which the impaling members of each truss plate of the pair extend toward the backing member of the other truss plate of the pair.

12. The apparatus defined in claim 11, wherein said stop unit is configured so that the peripheries of said backing members are offset longitudinally sufficiently so that said truss plates can form a nesting cooperating pair without interference between opposing impaling members.

13. The apparatus defined in claim 11, further comprising a drive unit for driving said truss plates from said aligning means.

14. The apparatus defined in claim 13, wherein said drive unit comprises a drive wheel that engages upper edges of said truss plates of said pair.

15. The apparatus defined in claim 13, further comprising a unit for operatively coupling said drive unit and said stop unit so that retraction of said stop unit actuates said drive unit to drive said truss plates from said stop unit, and so that retraction of said stop unit actuates said drive unit to drive said truss plates from said stop unit, and so that extension of said stop unit disengages said drive unit.

16. The apparatus defined in claim 13, wherein said directing unit is operatively coupled to said drive unit such that actuation of said drive unit to engage said truss plates accompanies actuation of said directing unit.

17. The apparatus defined in claim 11, wherein said directing unit is operatively coupled to said stop unit such that retraction of said stop unit to the retracted position accompanies actuation of said directing unit.

18. The apparatus defined in claim 11, wherein said retractable stop unit is configured to halt the movement of truss plates having backing members with a plurality of elongated apertures therein, wherein the impaling members of each of said truss plates are arranged in pairs, with one of said impaling members of the pair being positioned adjacent one end of an aperture, and the other impaling member being positioned at an opposite end of the aperture, such that said directing unit directs truss plates so configured to form nesting cooperating pairs without interference between opposing impaling members.

19. The apparatus defined in claim 18, wherein the truss plates include impaling members arranged in a staggered pattern, and wherein said stop unit is configured to halt the movement of such truss plates so that, as said directing unit directs pairs of truss plates into nesting cooperating pairs, the impaling members of opposed truss plates fail to interfere with each other.

20. The apparatus defined in claim 11, further comprising a position-detecting unit operably associated with said stop unit, said position-detecting unit being configured to detect the presence of a truss plate in a predetermined position and to actuate the retraction of said stop unit from the extended position to the retracted position upon detection of a truss plate in said predetermined position.

* * * * *

UNITED STATES PATENT AND TRADEMARK OFFICE

CERTIFICATE OF CORRECTION

PATENT NO. : 5,678,395

DATED : October 21, 1997

INVENTOR(S) : Black, Jr.

It is certified that error appears in the above-identified patent and that said Letters Patent is hereby corrected as shown below:

In column 24, line 6, after "an" please delete the word "of".

In column 25, line 6, please delete the phrase "detection of a" and replace with --the retracted--.

Signed and Sealed this

Twenty-first Day of April, 1998

Bruce Lehman

*Attest:*

BRUCE LEHMAN

*Attesting Officer*

*Commissioner of Patents and Trademarks*